US011738245B2

(12) United States Patent
Lambeth et al.

(10) Patent No.: US 11,738,245 B2
(45) Date of Patent: Aug. 29, 2023

(54) GOLF CLUB HEAD

(71) Applicant: Sumitomo Rubber Industries, Ltd., Kobe (JP)

(72) Inventors: Jacob Lambeth, Irvine, CA (US); Anthony Munson, Huntington Beach, CA (US); Dustin Brekke, Fountain Valley, CA (US)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 17/328,611

(22) Filed: May 24, 2021

(65) Prior Publication Data

US 2022/0001249 A1 Jan. 6, 2022

Related U.S. Application Data

(63) Continuation-in-part of application No. 16/920,504, filed on Jul. 3, 2020, now Pat. No. 11,247,106.

(51) Int. Cl.

| | |
|---|---|
| ***A63B 53/04*** | (2015.01) |
| ***A63B 53/00*** | (2015.01) |
| ***A63B 53/08*** | (2015.01) |

(52) U.S. Cl.

CPC ..... *A63B 53/047* (2013.01); *A63B 53/005* (2020.08); *A63B 53/042* (2020.08); *A63B 53/0408* (2020.08); *A63B 53/0433* (2020.08); *A63B 53/0462* (2020.08); *A63B 53/08* (2013.01); *A63B 2053/0479* (2013.01); *A63B 2053/0491* (2013.01)

(58) Field of Classification Search

CPC ..... A63B 53/047; A63B 53/0462; A63B 53/0408; A63B 53/005; A63B 53/08; A63B 53/0479; A63B 53/0491

USPC ..... 473/349

See application file for complete search history.

(56) References Cited

U.S. PATENT DOCUMENTS

| | | | | |
|---|---|---|---|---|
| 4,840,380 | A * | 6/1989 | Kajita | A63B 60/46 473/291 |
| 7,022,028 | B2 | 4/2006 | Nagai et al. | |
| 7,316,624 | B2 | 1/2008 | Sanchez | |
| 9,630,071 | B2 | 4/2017 | Thomas | |

(Continued)

OTHER PUBLICATIONS

Cleveland Golf, Launcher HB Turbo Irons; 2021; accessed May 24, 2021 at: https://www.clevelandgolf.com/en/irons-/launcher-hb-turbo-irons/MLHBTIS.html.

(Continued)

*Primary Examiner* — Raeann Gorden

(74) *Attorney, Agent, or Firm* — Barry IP Law, P.C.

(57) ABSTRACT

Golf club heads including a striking face with a variable thickness, a shell including a crown, and an internal weight pad located on a lower portion of the shell. The center of gravity depths of at least two golf club heads in a set satisfy the equation: D=a−b*LA, with 19 mm<a<22 mm and b=0.36 mm/degrees, and the at least two golf club heads have a difference in loft angle LA of at least 5 degrees. A moment of inertia about a vertical axis through the center of gravity of each of the at least two golf club heads is at least 2900 g*cm$^2$. In one aspect, a striking face has a center region having a first thickness T1, an intermediate region having a second thickness T2, and a perimeter region having a third thickness T3, with T2<T1<T3.

18 Claims, 18 Drawing Sheets

(56) References Cited

U.S. PATENT DOCUMENTS

| | | | | |
|---|---|---|---|---|
| 10,456,643 | B2 | 10/2019 | Motokawa et al. | |
| 2005/0130766 | A1* | 6/2005 | Nakahara | A63B 53/047 473/345 |
| 2015/0087434 | A1* | 3/2015 | Hayashi | A63B 53/04 473/291 |
| 2017/0259134 | A1 | 9/2017 | Ines et al. | |
| 2017/0304691 | A1 | 10/2017 | Morales et al. | |

OTHER PUBLICATIONS

Stachura, Mike; "Srixon Z-series irons meet the distance and feel needs of two classes of better players"; Golf Digest; Aug. 27, 2018; 6 pages; available at: https://www.golfdigest.com/story/srixon-z-series-irons-meet-the-distance-and-feel-needs-of-two-classes-of-better-players.

* cited by examiner

GOLF CLUB HEAD

CROSS-REFERENCE TO RELATED APPLICATION

This application is a continuation-in-part of U.S. application Ser. No. 16/920,504, titled "GOLF CLUB HEADS WITH VARIABLE FACE THICKNESS", and filed on Jul. 3, 2020, the entire contents of which are hereby incorporated by reference.

BACKGROUND

Golf club heads have mass and performance properties that affect the quality and consistency of shots when hitting a golf ball. Such mass and performance properties are often related to the mass or the distribution of mass in the golf club head. Examples of such mass and performance properties can include the location of a Center of Gravity (CG) for the club head, Coefficients of Restitution (CORs) or Characteristic Times (CTs) at various locations on a striking face of the club head, and Moments of Inertia (MOIs) about different virtual axes passing through the CG.

As example of a mass property affecting performance, the location of the CG can affect, for example, how high a golf ball is hit, the amount of spin on the golf ball, or the forgiveness of a club head in terms of ball speed and straightness for shots where the impact occurs at off-center locations away from a "sweet spot" on the striking face. As conventionally defined, the sweet spot is the point on the striking face from which a normal projection passes through the club head's CG. For example, moving the CG lower toward the sole, and back from the striking face of an iron type club head can advantageously increase the height of shots for longer distance and result in more backspin on the golf ball for a more controlled shot. Locating the sweet spot closer to the center of the striking face may also better align the sweet spot to a player's expected sweet spot location. Due to the asymmetric shaping and mass distribution of traditional iron-type golf club heads, a laterally centered CG location typically requires, for example, including high density weights, which can be costly and negatively affect swing weight.

As another example of a mass property affecting performance, greater MOIs in a club head mean that the club head is more resistant to twisting when the golf ball is hit at off-center positions on the striking face that are farther from the sweet spot. Increasing the MOIs of the club head generally results in the club head being more stable or forgiving for off-center shots, allowing such off-center shots to be straighter and have a faster ball speed due to the greater MOIs.

As an example of a performance property, the COR is a measurement of energy loss or energy transfer between the striking face and the golf ball. Higher measured CORs on the striking face translate to less energy loss or better energy transfer when the striking face impacts the golf ball. More energy is transferred to the golf ball with a higher COR, which translates to a faster ball speed that typically results in a farther shot. The COR can be measured, for example, using conventional cannon testing in keeping with the United States Golf Association's (USGA's) prescribed method for determining the COR. In this regard, the USGA has migrated from using the COR to using a different performance property referred to as a Characteristic Time (CT) measurement to quantify the elasticity of the striking face. For all purposes herein, the CT refers to characteristic time as described in the USGA's "Procedure for Measuring the Flexibility of a Golf Clubhead" (Rev. 1.0.0, May 1, 2008).

The improvement of mass and performance properties of a club head are balanced against structural requirements for the intended use of the club head, such as stress properties. Mass and performance properties are also balanced against other limits, such as limits prescribed by regulatory bodies, such as the USGA, concerning the CT, dimensions, and club head mass. In addition, players generally have implicit expectations for club heads, such as an overall appearance with respect to size, or an overall expected weight of the club head for the type of golf club or the loft angle of the golf club.

SUMMARY

The present inventors recognized a need for a variable face thickness pattern for golf club heads, particularly iron-type club heads, that improves mass and performance properties of club heads, while maintaining similar stress limits, appearance, and overall club head weight. As discussed in more detail below, the improved mass and performance properties can include, for example, Coefficients of Restitution (CORs), Characteristic Times (CTs), Moments of Inertia (MOIs), and/or a Center of Gravity (CG) location for the club head. In some example embodiments, a cavity-back or a hollow bodied, iron-type club head has an improved variable face thickness pattern that allows for discretionary weight to be moved from the striking face of the club head to other areas of the club head to improve mass and/or performance properties of the club head. Advantageously, such club heads may have improved mass and performance properties, such as higher CORs on the striking face, higher MOIs, and more laterally centered, deeper, and lower CG locations than comparable club heads, while maintaining similar stress limits. Additionally, such club heads do not sacrifice traditional appearances, dimensions (e.g., blade length, topline thickness), and overall club head weight (e.g., swing weight) that may be preferred by some players.

Reducing weight in the face while maintaining an overall club head weight can be important for players who may associate specific lofts of a golf club head with a certain mass, and have a preferred golf club swing weight. Generally, when presented in a set, iron-type club heads increase in mass with loft. For example, the mass of iron-type club heads may adhere to the following equation:

$$mh = 2.1 \text{ g/degree} * LA + a, \qquad \text{Equation 1}$$

where mh is a club head mass in grams, LA is the loft angle of the club head when orientated in a reference position, and a is between 190 g and 210 g. In one or more embodiments, a golf club head maintains such a head mass mh, while having an improved face thickness pattern. Such a club head may have an improved face thickness pattern with a vertical MOI extending through the CG, Izz, that satisfies:

$$Izz > mh * 9.0 \text{ cm}^2. \qquad \text{Equation 2}$$

In one or more aspects of the disclosure, a golf club head, when orientated in the reference position, includes a golf club head main body having a toe, a heel opposite the toe, a sole, and a top portion opposite the sole. The club head has a mass mh that satisfies Equation 1. In addition, the club head has a blade length less than 80 mm. The striking face of the club head defines a face plane and has a face center, and a virtual center plane extends vertically through the face center perpendicular to the face plane. As used herein, a face center of a striking face is determined according to the procedure described in the USGA's "Procedure for Measuring the Flexibility of a Golf Clubhead" (Rev. 2.0, Mar. 25, 2005). A CG of the club head is located not more than 2.0 mm from the virtual center plane, and an MOI about a vertical axis extending through the CG, Izz, satisfies $Izz>mh*9.3\ cm^2$.

In some aspects, the striking face includes a central region including the face center, an intermediate region at least partially surrounding the central region, an upper region above the central region, an upper region above the central region, a lower region below the central region, and a toe region toe-ward of the central region. Each of the central region, the upper region, the lower region, and the toe region include a maximum width and an average thickness, and the intermediate region is disposed between the central region and each of the upper region, the lower region, and the toe region. The intermediate region has an average thickness greater than that of each of the central region, the upper region, the lower region, and the toe region. In one or more embodiments, the intermediate region fully surrounds the central region.

According to some aspects, at least one of the toe region, the upper region, and the lower region includes, on a rear surface thereof, an elongate groove or recess having a width no less than about 2.0 mm. Alternatively or additionally, the upper region, the lower region, and the toe region respectively include, on a rear surface thereof, an upper groove or recess extending generally in a heel to toe direction, a lower groove or recess extending generally in a heel to toe direction, and a toe groove or recess extending generally in a top to bottom direction.

In one or more aspects of the disclosure, a golf club head, when orientated in a reference position, includes a golf club head main body having a toe, a heel opposite the toe, a sole, and a top portion opposite the sole. A face insert of the club head has a mass mf fixedly attached to the golf club head main body and includes a striking face that defines a face plane. The club head has a mass mh that satisfies Equation 1. The club head has a blade length less than 80 mm, and an MOI, Izz, about a vertical axis extending through a CG of the club head that satisfies $Izz>mh*9.3\ cm^2$. In addition, a ratio mf/mh is less than or equal to 0.22. In one or more embodiments, the ratio mf/mh of an iron-type golf club head is less than or equal to 0.20.

In some aspects, the striking face includes a sweet spot corresponding to a first COR, COR1, and an auxiliary location spaced at least 7.5 mm from the sweet spot corresponding to a second COR, COR2, where: $COR2 \geq 0.98*COR1$. In some implementations, a variable thickness of the striking face may provide for a higher COR near the sweet spot, increase the COR in a region including the sweet spot, and/or provide a larger area of a higher COR near the sweet spot. In another aspect, the relocation of mass from the striking face can move the CG so that the sweet spot corresponds to an area with a higher COR and/or a more frequently hit area of the striking face by players. For example, the central region of the striking face may include a heel-side region that has a greater thickness than a toe-side region so as to improve the COR in areas of the striking face that are more commonly hit by players.

The recesses or grooves on the rear surface of striking faces of the present disclosure not only increase the COR of the striking face, but can also improve weight distribution of the club head by relocating mass from the striking face to other areas of the club head to increase MOIs and/or to better locate the CG of the club head for better performance. The recesses or grooves may also be determined with a stress limit on the striking face as a constraint so that the striking face is comparable to prior art club heads when tested for durability, despite the reduced mass of the striking face.

In one or more aspects of the disclosure, a method of manufacturing a golf club head includes forming a golf club head main body having a striking face, a heel portion, a toe portion opposite the heel portion, a sole, a top portion opposite the sole, and a blade length no greater than 80 mm. A thickness pattern of the striking face is formed by defining on the striking face a central region including the face center, an intermediate region at least partially surrounding the central region, and at least one of an upper region above the central region, a lower region below the central region, and a toe region toe-ward of the central region. The intermediate region can be disposed between the central region and each of, or at least one of, the upper region, the lower region, and the toe region. The central region is recessed such that the central region has a thickness less than the intermediate region. At least one of the toe region, the upper region, and the lower region is recessed such that the recessed region has a thickness less than that of the central region. The variable face thickness pattern is formed such that the striking face includes a sweet spot corresponding to a first COR, COR1, and an auxiliary location spaced at least 7.5 mm from the sweet spot corresponding to a second COR, COR2, where $COR2 \geq 0.98*COR1$.

In one or more aspects of the disclosure, a method of manufacturing a golf club head includes forming a golf club head main body having a striking face, a heel, a toe opposite the heel, a sole, and a top portion opposite the sole. A variable thickness pattern is determined with a computing device by defining on the striking face a plurality of parameterization zones, including a central zone having the face center. Each of the parameterization zones includes at least one of a variable first parameter and a variable second parameter. A target value is set for at least one of a respective first constraint, second constraint, and third constraint. Each of the at least one variable first parameter and second parameter is varied for each of the parameterization zones. Impact of the striking face with a golf ball is simulated, and resultant values are evaluated against the target value for the at least one of first constraint, second constraint, and third constraint. The determined variable thickness pattern is formed on the striking face based on the evaluation. In some implementations, the first constraint is a striking face mass, the second constraint is mechanical stress on the striking face, and the third constraint is a weighted COR representing an overall effective or expected COR for the striking face based on the CORs for different portions of the striking face that have been weighted by their expected golf ball impact probabilities. In addition, the variable first parameter and the variable second parameter, in some implementations, may include a variable maximum width and a variable thickness for the parameterization zone or region.

In one or more aspects of the disclosure, a method of manufacturing a golf club head includes forming a golf club head main body having a striking face, a heel, a toe opposite the heel, a sole, and a top portion opposite the sole. A variable thickness pattern is determined with a computing device by defining on the striking face a central region including a face center of the striking face, an intermediate region at least partially surrounding the central region, an upper region above the central region, a lower region below the central region, and a toe region toe-ward of the central region. Each of the central region, the upper region, the lower region, and the toe region includes a variable width parameter and a variable thickness parameter. The intermediate region is disposed between the central region and each of the upper region, the lower region, and the toe region. A target value is set for at least one of a respective first constraint, second constraint, and third constraint. Each of the variable first parameter and the variable second parameter is varied for each region of the striking face. Impact of the striking face with a golf ball is simulated, and resultant values are evaluated against the target value for the at least one first constraint, second constraint, and third constraint. The determined variable thickness pattern is formed on the striking face based on the evaluation.

In one or more aspects of the disclosure, a set of iron-type golf clubs includes golf club heads that, when oriented in a reference position, each include a striking face comprising a face center and a variable thickness, a shell including a crown, a sole opposite the crown, a heel, a toe, and an internal weight pad located on a lower portion of the shell. The golf club heads in the set have a loft angle LA of at least 20 degrees and a center of gravity having a center of gravity depth D. The center of gravity depths of at least two of the golf club heads satisfy the equation:

$$D=a-b*LA, \quad \text{Equation 3}$$

with 19 mm<a<22 mm and b=0.36 mm/degrees, and with the at least two golf club heads having a difference in loft L of at least 5 degrees. A moment of inertia about a vertical axis through the center of gravity of each of the at least two golf club heads is at least 2900 $g*cm^2$.

In one or more aspects of the disclosure, an iron-type golf club head, when orientated in a reference position, includes a striking face comprising a face center and a variable thickness with a center region having a first thickness T1, an intermediate region having a second thickness T2 surrounding the center region, and a perimeter region surrounding the intermediate region having a third thickness T3, and with T2<T1<T3. The golf club head further comprises a shell including a crown, a sole opposite the crown, a heel, a toe, and an internal weight pad located on a lower portion of the shell. A loft angle LA of the golf club head is at least 20 degrees, and the golf club head has a center of gravity depth D satisfying Equation 3 above, with 19 mm<a<22 mm and b=0.36 mm/degrees. A moment of inertia about a vertical axis through the center of gravity is at least 2900 $g*cm^2$.

The various exemplary aspects described above may be implemented individually or in various combinations. The foregoing features and advantages, as well as other features and advantages, of the golf club heads of the present disclosure will become apparent to those of ordinary skill in the art after consideration of the following description, the accompanying drawings, and the appended claims.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure, and not to limit the scope of what is claimed.

DETAILED DESCRIPTION

Representative examples of one or more novel and non-obvious aspects and features of the golf club heads and methods of manufacturing such club heads as disclosed below are not intended to be limiting in any manner. Furthermore, the various aspects and features of the present disclosure may be used alone or in a variety of novel and nonobvious combinations and sub-combinations with one another.

Figure 1:
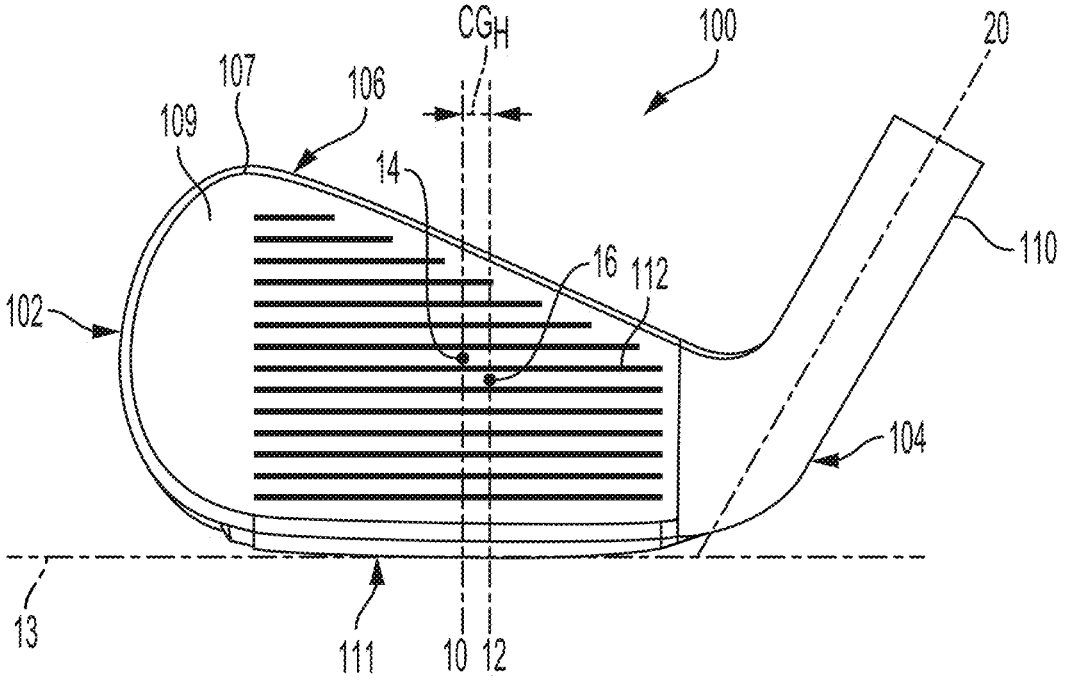
FIG. 1 is a front view of an exemplary golf club head according to one or more embodiments.

FIG. 1 is a front view of exemplary golf club head 100 according to one or more embodiments. As shown in FIG. 1, club head 100 includes toe portion 102, heel portion 104, topline portion 106, and sole portion 111. Club head 100 also includes hosel 110 that extends from heel portion 104. Hosel 110 may include an open end for receiving a golf club shaft (not shown) of a golf club. Hosel axis 20 extends axially through the center of hosel 110, and lies in a virtual vertical hosel plane (e.g., virtual vertical hosel plane 21 shown in FIG. 3). Club head 100, including striking face 109, may be formed, for example, of a steel material.

In FIG. 1, club head 100 is oriented in a reference position with sole portion 111 in contact with virtual ground plane 13, and with central hosel axis 20 in the virtual vertical plane. As used herein, a club head is orientated in the "reference position" when the sole of the club head (e.g., sole portion 111) is in contact with a virtual ground plane (e.g., virtual ground plane 13), its central hosel axis (e.g., central hosel axis 20) is positioned in a vertical plane, and its score-lines (e.g., score-lines 112) are parallel to the ground plane. In the reference position, club head 100 is positioned at a predetermined Loft Angle (LA) (i.e., LA in FIG. 3) and a predetermined lie angle (i.e., a in FIG. 2). Unless otherwise indicated, all parameters of the various embodiments in this disclosure are specified with the club heads orientated in the reference position.

In one or more embodiments, LA ranges from about 18 degrees to about 40 degrees. In other embodiments, the golf club head is a wedge-type golf club head and LA ranges from about 40 degrees to about 64 degrees.

As shown in FIG. 1, club head 100 includes striking face 109 configured to strike a conventional golf ball. In some implementations, striking face 109 may form part of a face insert that is fixedly attached to a main body of club head 100. In other implementations, striking face 109 may be integrally formed as part of the main body of club head 100. Striking face 109 is provided with one or more grooves or score-lines 112, which impart additional spin to the golf ball when struck. In FIG. 1, striking face 109 includes face center 14, which is located on virtual center plane 10 that extends vertically through face center 14 perpendicularly to a face plane defined by striking face 109 (e.g., face plane 22 in FIG. 3). As used herein, a "face center" of a striking face is determined according to the procedure described in the United States Golf Association's (USGA's) "Procedure for Measuring the Flexibility of a Golf Clubhead" (Revision 2.0, Mar. 25, 2005). In the example of FIG. 1, face center 14 denotes a point on striking face 109 that is midway between the heel-to-toe extents of score-lines 112, and midway between the sole-to-topline extents of striking face 109. In other embodiments, score-lines may extend to a toe-side edge of the striking face. In such embodiments, the lateral dimension of the face center is determined as midway between the heel-most extent of the score-lines and a club face apex, such as club face apex 107 in FIG. 1.

In the example of FIG. 1, sweet spot 16 is located on striking face 109 a horizontal distance, $CG_H$, toward heel portion 104 from virtual center plane 10. Sweet spot 16 is located on virtual vertical CG plane 12 such that sweet spot 16 is located on striking face 109 where a virtual line projected normal to a face plane of striking face 109 (e.g., face plane 22 in FIG. 3) passes through a CG of club head 100 (e.g., CG 18 in FIG. 2). As used herein, a club head's "sweet spot" is defined as a location on the club head's striking face from which a virtual line projected normal to a face plane of the striking face passes through the club head's CG location.

As discussed in more detail below, striking face 109 has been formed with a variable thickness in different regions or parameterization zones of striking face 109 to provide improved mass and/or performance properties of club head 100. Such properties can include, for example, greater Coefficients of Restitution (CORs) and/or greater Characteristic Times (CTs) on a larger area and/or more commonly hit area of striking face 109, greater Moments of Inertia (MOIs) about a virtual vertical CG axis (e.g., virtual vertical CG axis 24 in FIG. 4) and/or about a virtual horizontal CG axis (e.g., virtual horizontal CG axis 15 in FIG. 2), and/or an improved CG location for club head 100. The improvement of these mass and performance properties can be accomplished by the selective thinning or thickening of the different regions or parameterization zones and/or the relocation of discretionary mass from the striking face to other portions of the club head. As used herein, a striking face thickness is measured perpendicular to a face plane defined by the striking face (e.g., face plane 22 in FIG. 3 and face plane 42 in FIG. 6).

A total mass of the club head may serve as a target total mass comprised of structural mass and discretionary mass. Structural mass as used herein generally refers to mass necessary to establish a minimum structural integrity for the club head to be operable for its intended use. Discretionary mass, on the other hand, can refer to the remaining mass that, given a target mass, is not needed to establish the minimum structural integrity of the club head, and may therefore be located primarily to adjust mass and/or performance properties of the club head.

For example, the thickness of different regions or parameterization zones of striking face 109 can result in mass being moved from such regions or parameterization zones to other locations in club head 100 to provide higher MOIs of club head 100 and an improved location for the CG of club head 100 (e.g., CG 18 in FIG. 2), while increasing COR values in particular locations on the striking face. For example, mass removed from particular areas of the striking face can improve the COR of the striking face and the removed mass can be relocated in the club head so that the CG of club head 100 can be advantageously located closer to virtual center plane 10, closer to virtual ground plane 13, and farther behind striking face 109. As a result, sweet spot 16 can be advantageously located closer to face center 14 to better correspond to a player's expected sweet spot location and/or a more frequently hit area the striking face, and to provide a more forgiving club head to result in better off-center shots in terms of shot height, straightness, and distance. In this regard, sweet spot 16 in some implementations can be located horizontally no greater than 2.0 mm from face center 14 as a result of the relocation of mass from striking face 109 in accordance with the present disclosure. In other words, the CG of club head 100 (e.g., CG 18 in FIG. 2) in such implementations can be located not more than 2.0 mm from virtual center plane 10. In one or more embodiments, golf club heads having this lateral CG location do not include any high-density materials (e.g., tungsten alloys).

As noted above, the variable thickness pattern of the striking face discussed in more detail below can increase the COR at locations on striking face 109 corresponding to more commonly hit locations or a larger area of striking face to provide better energy transfer for off-center shots or for a statistically greater number of shots. Additionally or alternatively, the disclosed variable thickness patterns for a striking face can increase the area of the striking face that has a relatively high COR. For example, in some implementations, striking face 109 in FIG. 1 may include a maximum COR no less than 0.80 at a first location, and a COR of no less than 98% of the maximum COR at an auxiliary location on the striking face that is no less than 7.5 mm from the first location. In such implementations, the first location corresponding to the maximum COR may be at or near sweet spot 16, such as within 5 mm of sweet spot 16. Some implementations of variable thickness patterns discussed below for improving CORs on the striking face include, for example, a central region of the striking face having a heel-side thickness greater than a toe-side region.

Figure 2:
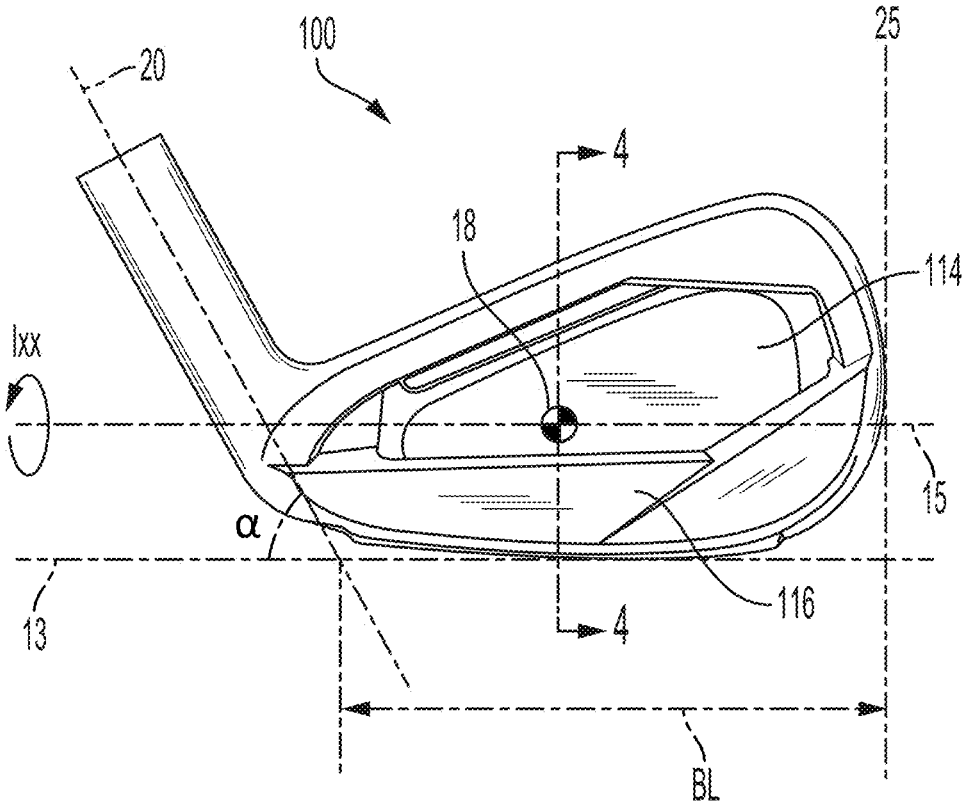
FIG. 2 is a rear view of an exemplary cavity-back club head according to one or more embodiments.

FIG. 2 is a rear view of an exemplary cavity-back club head according to one or more embodiments. In this regard, club head 100 in FIG. 2 includes rear cavity 114 behind at least a portion of striking face 109, and rear muscle 116 near sole portion 111. For the purposes of ease of illustration, FIG. 2 provides a rear view of club head 100 from FIG. 1. However, those of ordinary skill in the art will appreciate with reference to the present disclosure that club head 100 may include a different construction in other implementations, such as the hollow body construction shown in FIG. 6, for example.

As shown in FIG. 2, CG 18 is located on virtual horizontal CG axis 15. A horizontal MOI of golf club head 100, Ixx, is shown about virtual horizontal CG axis 15, which extends through CG 18 and is parallel to striking face 109. As noted above, the reduction of mass achieved by varying the thickness of striking face 109 can allow for an increased Ixx, and thereby improve performance of golf club head 100 for off-center shots in a vertical direction along striking face 109 (e.g., toward topline portion 106 or toward sole portion 111).

Club head 100 in FIG. 2 has a Blade Length (BL) measured between a toe-most extent of club head 100 at virtual vertical toe plane 25 and the intersection of hosel axis 20 and ground plane 13, which also defines lie angle $\alpha$. In some implementations, club head 100 can have a BL less than 80 mm. This blade length may, for example, correspond to an expected BL for an iron-type club head. In this regard, changes can be made to the thickness of striking face 109 without sacrificing the conventional outer dimensions of club head 100, such as the BL or topline thickness of topline portion 106 (e.g., $TL_T$ in FIG. 3). In addition, the overall or target club head mass of club head 100 (e.g., swing weight) in some implementations may correspond to expected masses for iron-type club heads.

As noted above, the mass for iron-type club heads typically vary based on the Loft Angle (LA). When presented in a set, iron-type club heads can increase in mass with loft. For example, the mass of iron-type club heads may adhere the following equation:

$$mh = 2.1 \text{ g degree} * LA + a, \qquad \text{Equation 1}$$

where mh is a club head mass, LA is the loft angle of the club head when orientated in a reference position, and a is between 190 g and 210 g. In some implementations, club head 100 maintains such a head mass, mh, while having an improved face thickness pattern.

Figure 3:
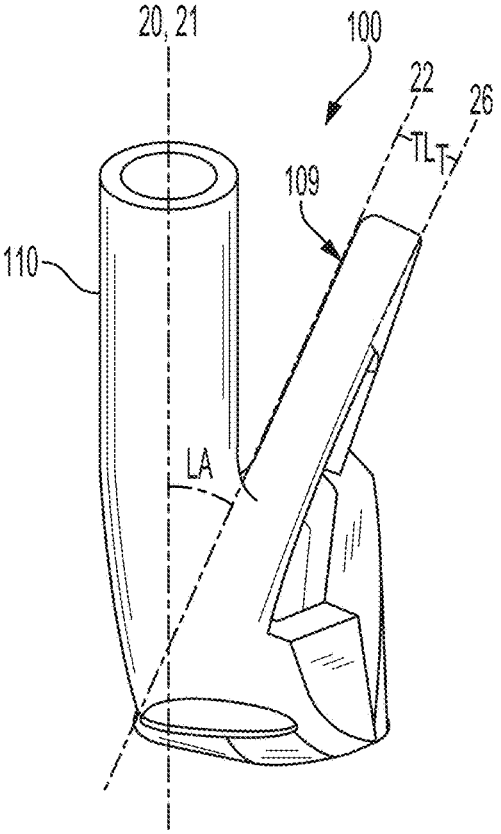
FIG. 3 is a heel side view of the cavity-back club head of FIG. 2 according to one or more embodiments.

FIG. 3 is a heel side view of club head 100 according to one or more embodiments. As shown in FIG. 3, the LA of club head 100 is defined between face plane 22 and virtual vertical hosel plane 21. As noted above, hosel axis 20 extends axially through the center of hosel 110, and lies in virtual vertical hosel plane 21. Face plane 22 is defined such that striking face 109 lies in face plane 22. With reference to Equation 1 above, the club head mass of club head 100 may vary depending on the LA of club head 100 such that higher numbered clubs with larger angles for LA have a greater club head mass.

As shown in FIG. 3, a distance between face plane 22 and rear side plane 26 defines Top Line Thickness ($TL_T$), which corresponds to a thickness of top line portion 106 shown in FIG. 1. The $TL_T$ of club head 100 is no greater than 6.5 mm. This $TL_T$ may correspond to an expected $TL_T$ for an iron-type club head. In this regard, changes can be made to the thickness pattern of striking face 109 without sacrificing the traditional outer dimensions of club head 100, such as the $TL_T$ of club head 100, which may be preferred by some golfers.

Figure 4:
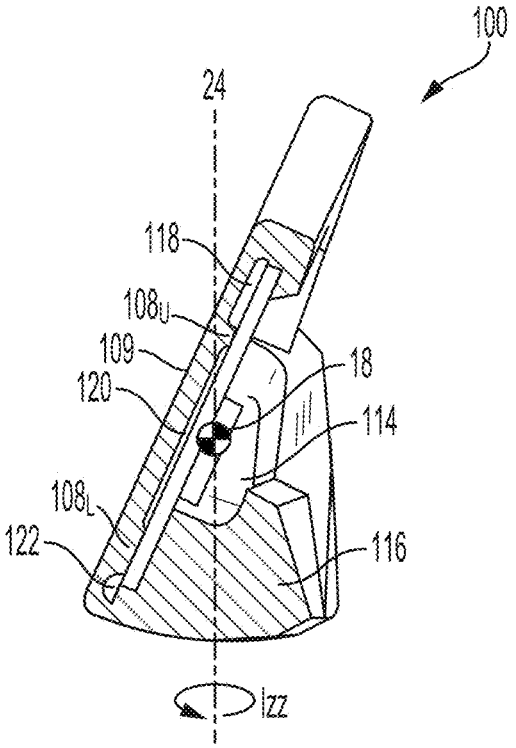
FIG. 4 is a cross-section view of the cavity-back club head of FIG. 2 according to one or more embodiments.

FIG. 4 is a cross-section view of club head 100 taken along cross section line 4 in FIG. 1 according to one or more embodiments. As shown in FIG. 4, a rear surface of striking face 109 facing rear cavity 114 and rear muscle 116 includes upper region groove 118, central region recess 120, and lower region groove 122. In implementations where striking face 109 includes a face insert, a rear surface of the face insert can include upper region groove 118, central region recess 120, and lower region groove 122.

The rear surface of striking face 109 also includes intermediate region 108 at least partially surrounding the central region including central region recess 120. In this regard, intermediate region 108 includes upper intermediate region $\mathbf{108}_U$ and lower intermediate region $\mathbf{108}_L$ above and below central region recess 120, respectively. Each of the central region, the upper region, and the lower region including central region recess 120, upper region groove 118, and lower region groove 122, respectively, has an average thickness that is less than the average thickness of intermediate region 108, which may have an approximately uniform thickness. Upper region groove 118 and lower region groove 122 may extend in generally a heel to toe direction, as in the examples of upper region grooves 318 and 418 and lower region grooves 322 and 422 in FIGS. 7 and 8, respectively.

In some implementations, at least one of upper region groove 118 and lower region groove 122 can be an elongate groove having a width no less than approximately 2.0 mm. In addition, thickness of central region recess 120 may taper in some embodiments such that a heel-side region of the central recess may be thicker than a toe-side region of the central recess, as in the example of central region recess 320 in FIG. 7. As another example, the central recess can include a heel-side region that has a greater thickness than a toe-side region, as in the example of heel-side region 435 and toe-side region 433 in FIG. 8. In some implementations, the thickness of the central region may decrease stepwise from a heel-side of the central region toward a toe-side of the central region.

In FIG. 4, Izz, is centered about virtual vertical CG axis 24. Discretionary mass removed or saved from striking face 109 to form upper region groove 118, central region recess 120, and lower region groove 122 can be relocated to heel portion 104 and toe portion 102 to increase Izz. In some implementations, Izz may satisfy:

$$Izz > mh * 9.3 \text{ cm}^2 \qquad \text{Equation 2}$$

where mh is the mass of club head 100. As noted above, increasing the MOI about virtual vertical axis 24 extending through CG 18 improves the forgiveness of club head 100 so as to cause less bending of club head 100 about virtual vertical axis 24 during off-center shots in a horizontal direction along striking face 109 (e.g., shots that are more toe-ward or heel-ward of sweet spot 16).

In addition, the variable thickness pattern of striking face 109 can increase the COR at locations on striking face 109 corresponding to more commonly hit locations or a larger area of striking face to provide better energy transfer for off-center shots or for a statistically greater number of shots. The variable thickness pattern of striking face 109 with upper region groove 118, central region recess 120, and lower region groove 122 can increase the area of the striking face that has a relatively high COR.

For example, mass removed from particular areas of striking face 109 can improve the COR of striking face 109, and the removed mass can be relocated in club head 100 so that CG 18 can be advantageously located closer to a lateral center of striking face 109, closer to virtual ground plane 13, and farther behind striking face 109. In such an example, mass removed or saved from striking face 109 to form upper region groove 118, lower region groove 122, and central region recess 120, such as by machining (e.g., grinding, milling) or by a known casting or forging process, can be relocated to rear muscle 116 to lower the location of CG 18 and move CG 18 farther behind striking face 109. As another example, mass removed from striking face 109 can be relocated from a heel-side of striking face 109 to a toe-side of striking face 109 to move CG 18 away from heel portion 104 toward toe portion 102.

Those of ordinary skill in the art will appreciate with reference to the present disclosure that other implementations may vary from the arrangement shown in FIG. 4. For example, other implementations of a cavity-back club head may include a different shape of rear cavity 114 or rear muscle 116. As another example variation, the cross-section shapes of one or more of upper region groove 118, central region recess 120, and lower region groove 122 may differ from what is shown in FIG. 4 in other implementations. As yet another example variation, some implementations may not include central region recess 120, and only include one or more grooves adjacent a periphery of the rear surface of striking face 109, such as upper region groove 118 and/or lower region groove 122.

Figure 5:
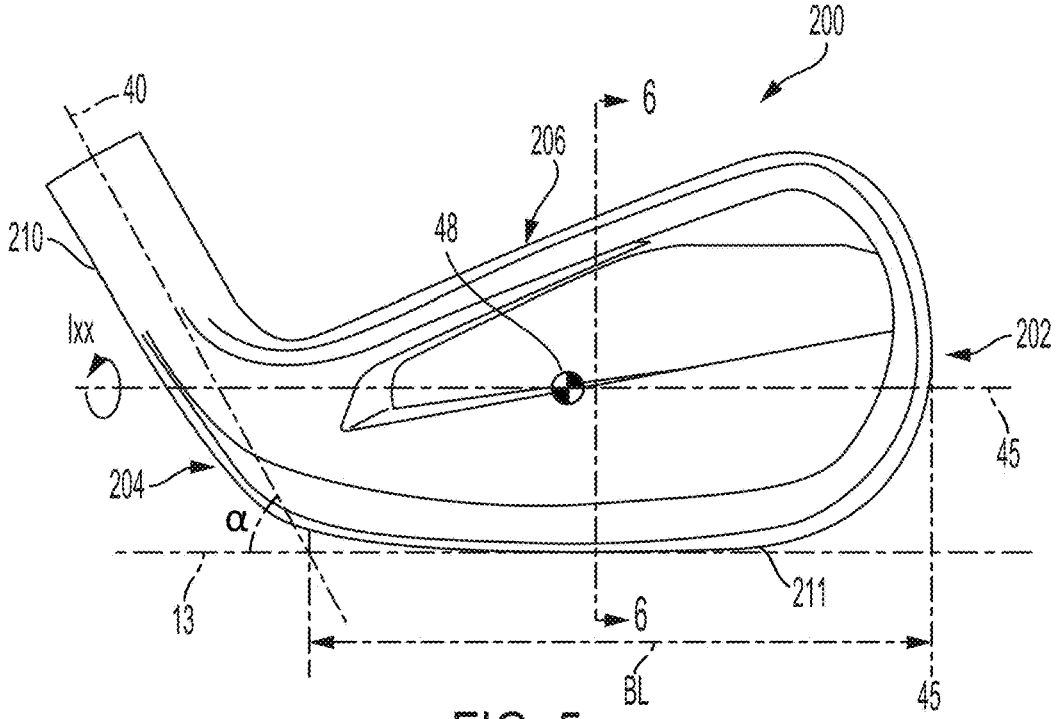
FIG. 5 is a rear view of an exemplary hollow club head according to one or more embodiments.
Figure 6:
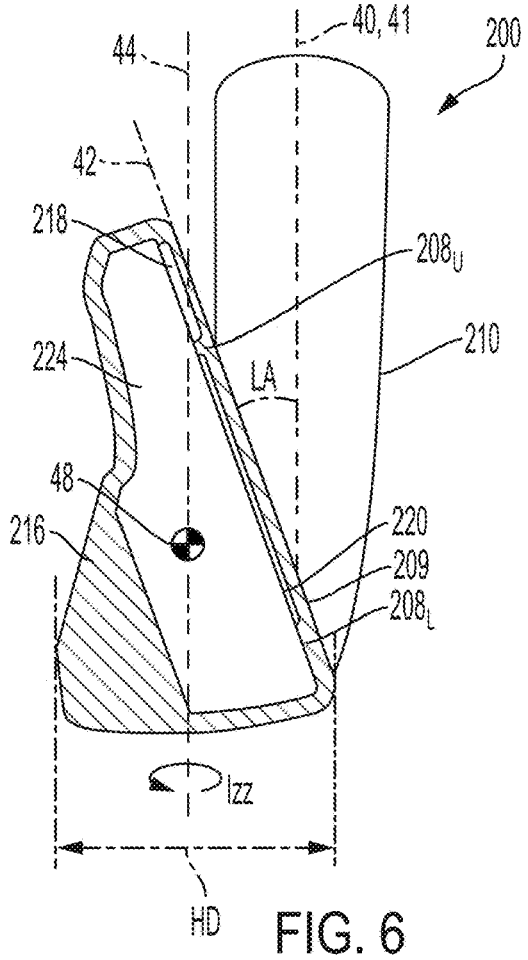
FIG. 6 is a cross-section view of the hollow club head of FIG. 5 according to one or more embodiments.

FIG. 5 is a rear view of exemplary hollow body club head 200 head according to one or more embodiments. Club head 200, including striking face 209, may be formed, for example, of a steel material. As with club head 100 in FIGS. 1 to 4, club head 200 includes a hosel 210, a toe portion 202, and a heel portion 204. However, instead of having a rear cavity such as with rear cavity 114 in FIGS. 2 and 4 for club head 100, club head 200 in FIGS. 5 and 6 includes interior cavity 224 behind at least a portion of striking face 209, as shown in FIG. 6. In some implementations, striking face 209 may form part of a face insert that is fixedly attached to a main body of club head 200. In other implementations, striking face 209 may be integrally formed as part of the main body of club head 200. For the purposes of ease of illustration, FIG. 5 provides a rear view of club head 200 that may have a similar exterior front appearance as club head 100 in FIG. 1. However, those of ordinary skill in the art will appreciate with reference to the present disclosure that club head 200 may include a different construction in other implementations than shown in FIGS. 5 and 6.

As shown in FIG. 5, CG 48 is located on virtual horizontal CG axis 45. A horizontal MOI of club head 200, Ixx, is shown about virtual horizontal CG axis 45, which extends through CG 48 and is parallel to striking face 209, which is shown in FIG. 6. The reduction of mass achieved by varying the thickness of striking face 209 can allow for an increased Ixx by relocating mass to other portions of club head 200, and thereby improve performance of golf club head 200 for off-center shots in a vertical direction along striking face 209 (e.g., toward topline portion 206 or toward sole portion 211).

Club head 200 in FIG. 5 has a Blade Length (BL) measured between a toe-most extent of club head 200 at virtual vertical toe plane 45 and the intersection of hosel axis 40 and ground plane 13, which also defines lie angle α. In some implementations, club head 200 can have a BL less than 80 mm. This blade length may, for example, correspond to an expected BL for an iron-type club head. In this regard, changes can be made to the thickness of striking face 209 without sacrificing the conventional outer dimensions of club head 200, such as the BL or topline thickness of topline portion 206. In addition, in some implementations, the overall or target club head mass of club head 200 (e.g., swing weight) may correspond to expected masses for iron-type club heads.

As noted above, the mass for iron-type club heads typically vary based on the Loft Angle (LA). As shown in FIG. 6, the LA of club head 200 is defined between face plane 42 and virtual vertical hosel plane 41. Virtual vertical hosel plane 41 includes hosel axis 40 that extends axially through the center of hosel 210. Face plane 42 is defined such that striking face 209 lies in face plane 42. The mass of club head 200 can satisfy Equation 1 provided above with respect to the LA, while having an improved face thickness pattern. In addition, club head 200 can have a depth less than that of a typical hybrid-type golf club head. For example, club head 200 may have a depth less than 30 mm, as measured from a leading edge to a trailing edge of sole portion 211 of club head 200. As noted above, the relocation of mass from striking face 209 can ordinarily allow for improved performance and mass properties, such as increased MOIs, better CG location, and increased CORs or CTs, without changing the expected dimensions, footprint, or exterior appearance of a conventional iron-type golf club head.

FIG. 6 is a cross-section view of club head 200 taken along cross-section line 6 in FIG. 5 according to one or more embodiments. As shown in FIG. 6, a rear surface of striking face 209 facing interior cavity 224 and rear muscle 216 includes upper region groove 218, and central region recess 220. In implementations where striking face 209 includes a face insert, a rear surface of the face insert can include upper region groove 218 and central region recess 220.

The rear surface of striking face 209 also includes intermediate region 208 at least partially surrounding the central region including central region recess 220. In this regard, intermediate region 208 includes upper intermediate region $\mathbf{208}_U$ and lower intermediate region $\mathbf{208}_L$ above and below central region recess 220, respectively. Each of the central region including central region recess 220, and the upper region including upper region groove or recess 218 has an average thickness that is less than the average thickness of intermediate region 208. In some implementations, intermediate region 208 may have an approximately uniform thickness. Upper region groove 218 may extend in generally a heel to toe direction, as in the examples of upper region grooves 318 and 418 in FIGS. 7 and 8, respectively.

In some implementations, upper region groove 218 can have an elongate groove having a width no less than approximately 2.0 mm. In addition, a thickness of central region recess 220 may taper in some implementations such that a heel-side region of the central recess may be thicker than a toe-side region of the central recess, as in the example of central region recess 320 in FIG. 7. As another example, the central recess can include a heel-side region that has a greater thickness than a toe-side region, as in the example of heel-side region 435 and toe-side region 433 in FIG. 8.

Such a tapering or variation of the central region thickness or central recess can also ordinarily improve the COR in the central region and/or increase an area of striking face 209 having a greater COR, as discussed below in more detail with reference to FIGS. 7 to 10. In addition, the thickness of different regions or parameterization zones of striking face 209 can result in mass being moved from such regions or parameterization zones to other locations in club head 200 to provide higher MOIs of club head 200 and an improved location for CG 48, while increasing COR values in particular locations on the striking face.

For example, mass removed from particular areas of striking face 209 can improve the COR of striking face 209, and the removed mass can be relocated in club head 200 so that CG 48 can be advantageously located closer to a lateral center of striking face 209, closer to virtual ground plane 13, and farther behind striking face 209. In such an example, mass removed from striking face 209 to form upper region groove 218 and central region recess 220, such as by machining or by a known casting or forging process, can be relocated to rear muscle 216 to lower the location of CG 48 and move CG 48 farther behind striking face 209. In some implementations, striking face 209 can be formed separately and attached to a main body of club head 200 by welding or other known methods. As another example, mass removed from striking face 209 can be relocated from a heel-side of striking face 209 to a toe-side of striking face 209 to move CG 48 away from heel portion 204 toward toe portion 202.

As a result, the sweet spot on striking face 209 (e.g., sweet spot 16 in FIG. 1) can be advantageously located closer to a face center (e.g., face center 14 in FIG. 1) to better correspond to a player's expected sweet spot location or to more frequently hit locations on striking face 209. In this regard, the sweet spot of club head 200 in some implementations can be located horizontally no greater than 2.0 mm from a face center as a result of the relocation of mass from striking face 209.

As noted above, the variable thickness pattern of the striking face can increase the COR at locations on striking face 209 corresponding to more commonly hit locations to provide better energy transfer for a statistically greater number of shots, resulting in an improved weighted COR for the striking face. Additionally or alternatively, the disclosed variable thickness patterns for a striking face can increase the area of the striking face that has a relatively high COR. For example, in some implementations, striking face 209 may include a maximum COR no less than 0.80 at a first location, and a COR of no less than 98% of the maximum COR at an auxiliary location on striking face 209 that is no less than 7.5 mm from the first location. In such implementations, the first location corresponding to the maximum COR may be at or near the sweet spot, such as within 5 mm of the sweet spot. Some implementations of variable thickness patterns discussed below for improving CORs on the striking face include, for example, a central region of the striking face having a heel-side thickness greater than a toe-side region.

In FIG. 6, Izz, is centered about virtual vertical CG axis 44. Discretionary mass removed or saved from striking face 209 to form upper region groove 218 and central region recess 220 can be relocated to heel portion 204 and toe portion 202 to increase Izz. In some implementations, Izz may satisfy Equation 2 provided above. Increasing the MOI about virtual vertical axis 44 extending through CG 48 improves the forgiveness of club head 200 so as to cause less bending of club head 200 about virtual vertical axis 44 during off-center shots in a horizontal direction along striking face 209 (e.g., shots that are more toe-ward or heel-ward of the sweet spot).

Those of ordinary skill in the art will appreciate with reference to the present disclosure that other implementations may vary from the arrangements shown in FIGS. 5 and 6. For example, other implementations of a hollow body club head may include a different shape of interior cavity 214 or rear muscle 216. As another example variation, the cross-section shapes of upper region groove 218 or central region recess 220 may differ from what is shown in FIG. 4 in other implementations. In this regard, other implementations may also include a lower region groove, as in the example of FIG. 4 discussed above. In yet other implementations, central region recess 220 may be omitted, such that the recess or recesses on the rear surface of striking face 209 may only include one or more grooves or channels adjacent a periphery of the rear surface, such as upper region groove 218.

Figure 7:
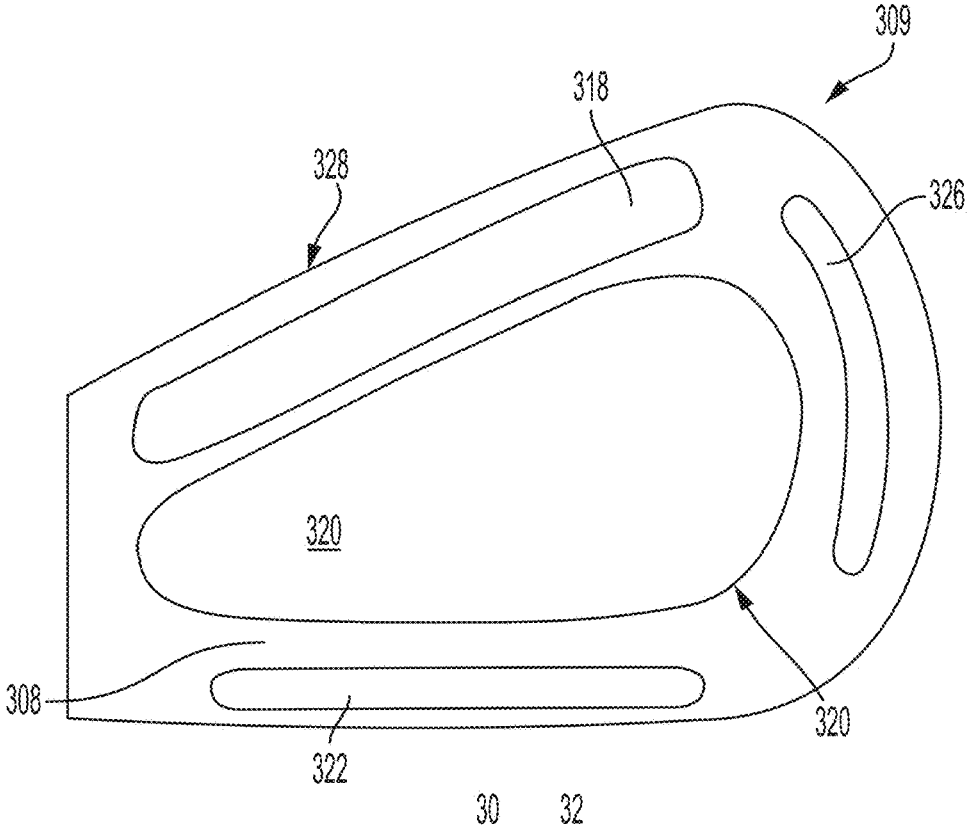
FIG. 7 depicts an exemplary rear surface of a striking face of a cavity-back club head according to one or more embodiments.

FIG. 7 depicts an exemplary rear surface 328 of striking face 309 of a cavity-back club head, such as cavity-back club head 100 in FIGS. 2 to 4, according to one or more embodiments. As shown in FIG. 7, rear surface 328 includes recesses in an upper region, a central region, a toe region, and a lower region. In more detail, rear surface 328 includes upper region groove or channel 318, toe region groove or channel 326, and lower region groove or channel 322 that are adjacent a periphery of rear surface 328. Central region recess 320 is formed in a central region between upper region groove 318, toe region groove 326, and lower region groove 322. Intermediate region 308 surrounds central region recess 320 and is disposed between central region recess 320 and each of upper region groove 318, toe region groove 326, and lower region groove 322. In addition, intermediate region 308 has an average thickness that is greater than that of each of central region recess 320, upper region groove 318, toe region groove 326, and lower region groove 322.

Preferred dimensions of central region recess 320 have a face thickness of no more than 2.5 mm, that preferably tapers from 2.3 mm on a heel-side of central region recess 320 to 1.9 mm on a toe-side of central region recess 320. Preferred dimensions of upper region groove 318 have a face thickness of no more than 1.5 mm, and a maximum width of no less than 5.0 mm. Preferred dimensions of toe region groove 326 have a face thickness less than upper region groove 318, and a maximum width no less than 2.0 mm. Preferred dimensions of lower region groove 322 have a face thickness of no more than 1.5 mm, that is preferably greater than toe region recess 326, and a width no less than 2.5 mm. As referred to herein, the width of a groove or channel is defined by a maximum perpendicular distance between the longer opposite sides of the groove or channel. A preferred thickness of intermediate region 308 surrounding the recesses of central region recess 320, upper region groove 318, toe region groove 326, and lower region groove 322 has a thickness less than 3 mm and greater than 2.5 mm, and preferably about 2.7 mm.

Some preferred dimensions for the recesses of rear surface 328 in FIG. 7 can include the dimensions in Table 1 below. As used below, the thickness refers to a thickness of striking face 309, the width refers to a distance measured perpendicular to opposing longest sides of the recess, and the radius refers to a radius of curvature between a bottom of the recess that has the face thickness indicated for the recess and an adjacent wall of the recess.

TABLE 1

| Club Head | Central Region Recess 320 | Upper Region Groove 318 | Toe Region Groove 326 | Lower Region Groove 322 |
|---|---|---|---|---|
| Club Head 1A | Thickness: 2.3 mm (heel-side) tapered to 1.9 mm (toe-side) Radius: 0.4 mm | Thickness: 1.5 mm Width: 6.5 mm Radius: 0.4 mm | Thickness: 0.9 mm Width: 2.5 mm Radius: 0.4 mm | Thickness: 1.2 mm Width: 3.0 mm Radius: 1.5 mm |
| Club Head 2A | Thickness: 2.4 mm (heel-side) tapered to 2.0 mm (toe-side) Radius: 0.4 mm | Thickness: 1.5 mm Width: 6.5 mm Radius: 0.4 mm | Thickness: 0.9 mm Width: 2.5 mm Radius: 0.4 mm | Thickness: 1.2 mm Width: 3.0 mm Radius: 1.5 mm |
| Club Head 3A | Thickness: 2.4 mm (heel-side) tapered to 2.0 mm (toe-side) Radius: 3.0 mm | Thickness: 1.5 mm Width: 6.5 mm Radius: 3.0 mm | Thickness: 0.9 mm Width: 2.5 mm Radius: 1.25 mm | Thickness: 1.2 mm Width: 3.0 mm Radius: 1.5 mm |

The foregoing preferred dimensions for central region recess 320, upper region groove 318, toe region groove 326, and lower region groove 322 improve performance and mass related properties of cavity-back club heads. Such performance and mass related properties include, for example, the CG location for the club head, CORs or CTs at various locations on the striking face, and MOIs about different virtual axes passing through the CG. The recesses on rear surface 328 not only increase the COR of striking face 309 with a reduction of mass in striking face 309 at particular locations, but can also improve the weight distribution of the club head to increase MOIs and/or better locate the CG for performance, as discussed above. The recesses on rear surface 328 may also be determined with maximum face stress as a constraint so that striking face 309 is comparable to prior art club heads when tested for durability, despite the reduced mass of striking face 309.

Those of ordinary skill in the art will appreciate with reference to the present disclosure that other implementations of a rear surface of a striking face for a cavity-back club head may differ from the arrangement shown in the example of FIG. 7. For example, other arrangements may not include one or more of the recesses shown in FIG. 7.

Figure 8:
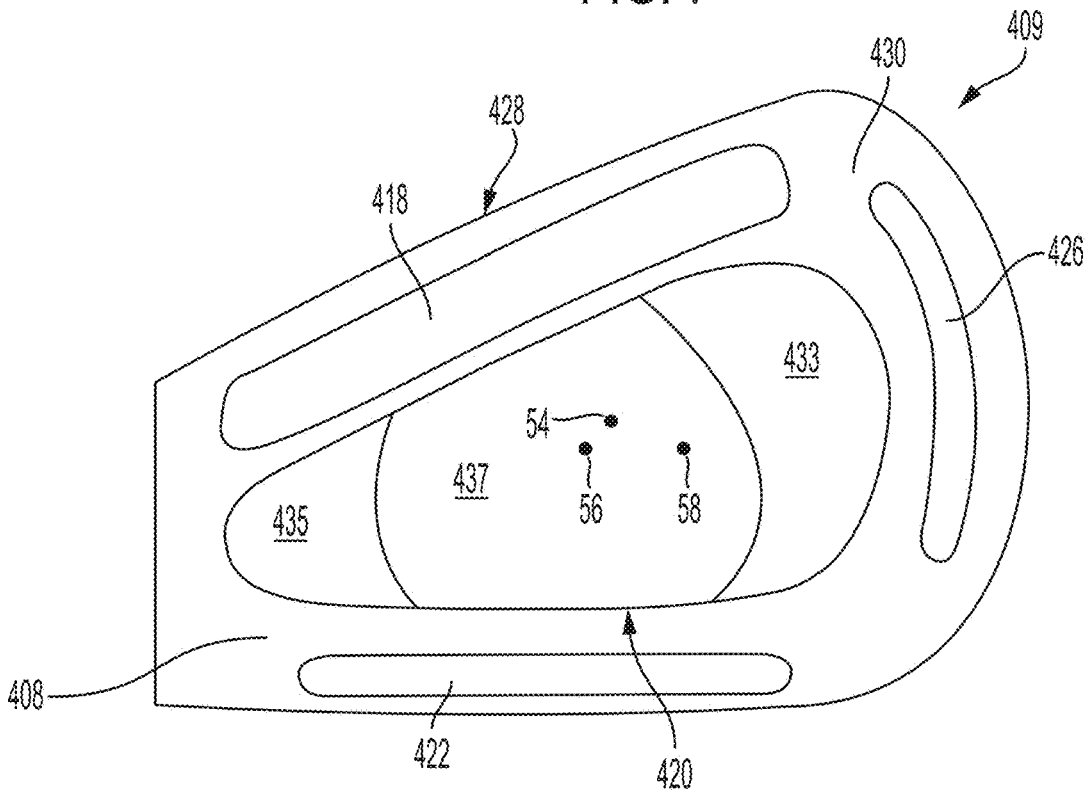
FIG. 8 depicts an exemplary rear surface of a striking face of a hollow club head according to one or more embodiments.

FIG. 8 depicts exemplary rear surface 428 of striking face 409 of a hollow body club head, such as hollow body club head 200 in FIGS. 5 and 6, according to one or more embodiments. As shown in FIG. 8, rear surface 428 includes recesses in an upper region, a central region, a toe region, and a lower region. However, unlike the example of rear surface 328 in FIG. 7, rear surface 428 in FIG. 8 includes a different thickness pattern for central region recess 420. In more detail, middle portion 437 of central region recess 420 is thicker than heel-side portion 435 and toe-side portion 433. Such an arrangement ordinarily further improves COR or CT for a larger area of striking face 409 in the central region.

In addition, rear surface 428 includes upper region groove or channel 418, toe region groove or channel 426, and lower region groove or channel 422 that are adjacent a periphery of rear surface 428. Central region recess 420 is formed in a central region between upper region groove 418, toe region groove 426, and lower region groove 422. Intermediate region 408 surrounds central region recess 420 and is disposed between central region recess 420 and each of upper region groove 418, toe region groove 426, and lower region groove 422. In addition, intermediate region 408 has an average thickness that is greater than that of each of central region recess 420, upper region groove 418, toe region groove 426, and lower region groove 422.

Some preferred thicknesses in striking face 409 for the recesses of rear surface 428 in FIG. 8 include the following thicknesses for Club Heads 1B, 2B, 3B, and 4B in Table 2 below. The central region thicknesses provided for the Comparable Club Head B in Table 2 are measured thicknesses of its striking face at the locations where the central region recesses of FIG. 8 (i.e., heel-side central region recess 435, middle central region recess 437, and toe-side central region recess 433) would otherwise be located. The Comparable Club Head B includes a continuous peripheral groove or channel of uniform width and depth along a majority of the periphery of the rear surface of its striking face. Table 2 also includes preferred widths for upper region groove 418, toe region groove 426, and lower region groove 422, as measured perpendicularly between the two longest opposing sides of the groove.

TABLE 2

| Recess Thickness or Width | Comparable Club Head B | Club Head 1B | Club Head 2B | Club Head 3B | Club Head 4B |
|---|---|---|---|---|---|
| Mid. Cent. Reg. Recess 437 Thickness | 2.3 mm | 1.8 mm | 2.0 mm | 2.0 mm | 2.0 mm |
| Heel Cent. Reg. Recess 435 Thickness | 2.3 mm | 2.0 mm | 2.2 mm | 2.2 mm | 2.2. mm |
| Toe Cent. Reg. Recess 433 Thickness | 2.3 mm | 1.6 mm | 1.8 mm | 1.8 mm | 1.8 mm |
| Upper Reg. Groove 418 Thickness | 1.1 mm | 1.1 mm | 1.1 mm | 1.1 mm | 1.1 mm |
| Toe Reg. Groove 326 Thickness | 1.1 mm | 0.9 mm | 0.9 mm | 0.9 mm | 0.9 mm |
| Lower Reg. Groove 422 Thickness | 1.1 mm | 1.3 mm | 1.3 mm | 1.3 mm | 1.4 mm |

TABLE 2-continued

| Recess Thickness or Width | Comparable Club Head B | Club Head 1B | Club Head 2B | Club Head 3B | Club Head 4B |
|---|---|---|---|---|---|
| Upper Reg. Groove 418 Width | 3.0 mm | 6.5 mm | 6.5 mm | 6.5 mm | 6.5 mm |
| Toe Reg. Groove 326 Width | 3.0 mm | 2.5 mm | 2.5 mm | 2.5 mm | 2.5 mm |
| Lower Reg. Groove 422 Width | 3.0 mm | 4.0 mm | 4.0 mm | 4.0 mm | 4.0 mm |

The foregoing preferred dimensions for central region recess 420 (i.e., middle central region recess 437, heel-side central region recess 435, and toe-side central region recess 433), upper region groove 418, toe region groove 426, and lower region groove 422 improve performance and mass related properties of hollow club heads. Such performance and mass related properties include, for example, the CG location for the club head, CORs or CTs at various locations on the striking face, and MOIs about different virtual axes passing through the CG. In this regard, Table 4 below provides measured or computer-simulated values for the removal of mass from striking face 409, the COR at face center 54, the COR at an off-center location 58 that is 7.5 mm toe-ward of sweet spot 56, and a weighted COR representing an expected or overall COR for striking face 409 that is calculated by weighting the CORs at different locations on striking face 409 using a probability that a golf ball will be hit at the location.

In some implementations, striking face 409 can include a maximum COR no less than 0.80 at a first location, such as at or within 5 mm of sweet spot 46, and a COR no less than 98% of the maximum COR at a second location 48 that is no less than 7.5 mm from the first location. The thicknesses of the recesses of striking face 409 may also be determined so as to increase a weighted COR. The weighted COR can be determined based on a bin-by-bin or location-by-location impact probability, as discussed in more detail in U.S. Pat. No. 10,456,643, titled "GOLF CLUB HEAD," and filed on Dec. 28, 2018, the entire contents of which are hereby incorporated by reference. The weighted COR, "expected COR" or "overall COR" may be considered to represent a probability-adjusted measure of club head performance that a typical golfer would actually expect given how impacts are empirically dispersed about striking face 409. Using such information, a golfer may make a more informed decision in selecting a golf club based on its weighted COR. Alternatively or additionally, a golfer may determine which golf clubs may be better suited to the golfer's specific handicap or skill level.

The weighted COR can be determined by superimposing onto striking face 409 a rectangular virtual evaluation region comprising a first pair of horizontal sides having a length of 35 mm, a second pair of vertical sides having a length of 25 mm, and a geometric center that coincides with the face center. The rectangular virtual evaluation region is divided into bins by dividing the rectangular virtual evaluation region into five rows (i.e., m=5) having equal height of 5 mm, and seven columns (i.e., n=7) having equal width of 5 mm, thereby forming a matrix of bins having coordinates i and j. An average COR is determined (e.g., measured or computer-simulated) for each bin represented by its coordinates i,j, and the weighted COR can be determined by Equation 3 below. In other implementations, a COR may be determined for a center position of each bin.

$$\text{Weighted COR}=\Sigma_{i=1}^{n}\Sigma_{j=1}^{m}p_{ij}*c_{ij} \qquad \text{Equation 4}$$

where $p_{ij}$ is an impact probability for the bin at coordinates i,j according to an impact probability matrix, such as Table 3 below.

TABLE 3

| | i = 1 | i = 2 | i = 3 | i = 4 | i = 5 | i = 6 | i = 7 |
|---|---|---|---|---|---|---|---|
| j = 1 | 0.42% | 0.43% | 0.30% | 0.22% | 0.11% | 0.03% | 0.03% |
| j = 2 | 3.58% | 3.64% | 2.96% | 2.23% | 1.20% | 0.76% | 0.31% |
| j = 3 | 5.46% | 8.29% | 8.54% | 6.50% | 4.42% | 2.43% | 1.06% |
| j = 4 | 3.36% | 5.97% | 6.55% | 6.65% | 5.01% | 2.83% | 1.19% |
| j = 5 | 1.52% | 2.43% | 3.31% | 3.18% | 2.49% | 1.80% | 0.81% |

Other impact probability matrices may be used to determine the weighted COR in different implementations. For example, other impact probability matrices for determining a weighted COR or expected COR can include those disclosed in U.S. Pat. No. 10,456,643 incorporated by reference above. As another example variation, the measurement locations for the CORs can correspond to points or a differently shaped boundary than the rectangular bins described above for Table 3. In yet other variations, the COR measurement locations can correspond to areas that are spaced apart form each other that do not abut. As another example variation, the orientation of the bins or COR measurement locations may not form a rectangular matrix, but rather, an irregular arrangement of a different configuration, such as an annulus or sunburst configuration.

The recesses on rear surface 428 not only increase CORs of striking face 409 with a reduction of mass in striking face 409 at particular locations, but can also improve the weight distribution of the club head to increase MOIs and/or better locate the CG for performance, as discussed above. The recesses on rear surface 428 may also be determined with maximum face stress as a constraint so that striking face 409 is comparable to prior art club heads when tested for durability, despite the reduced mass of striking face 409.

With reference to the dimensions in Table 2 above for the recesses of rear surface 428 in FIG. 8, Table 4 below provides computer-simulated or measured mass and performance properties for the corresponding Comparable Club Head B, Club Head 1B, Club Head 2B, Club Head 3B, and Club Head 4B. As shown in Table 4 below, the amount of mass removed or saved from the striking faces decreases from Club Head 1B to Club Head 4B, as the face center COR, off-center COR, and weighted COR decreases from Club Head 1B to Club Head 4B. However, each of Club Head 1B to Club Head 4B provide greater values for the amount of mass removed, face center COR, off-center COR, and weighted COR than for Comparable Club Head B.

TABLE 4

| Property | Comparable Club Head B | Club Head 1B | Club Head 2B | Club Head 3B | Club Head 4B |
|---|---|---|---|---|---|
| Mass Savings from Striking Face of Comparable Club Head | NA | 7.57 g | 5.67 g | 5.14 g | 4.97 g |
| Face Center COR | 0.7976 | 0.8098 | 0.8053 | 0.8043 | 0.8039 |
| Off-Center COR at 7.5 mm Toe-Ward of Sweet Spot | 0.7843 | 0.7997 | 0.7936 | 0.7931 | 0.7926 |
| Weighted COR | 0.7837 | 0.7953 | 0.7910 | 0.7902 | 0.7897 |

Those of ordinary skill will appreciate with reference to the present disclosure that other arrangements of recesses are possible than those shown in FIG. 8. In this regard, the removal of mass from striking face 309 with the recesses formed in rear surface 328 in FIG. 7 discussed above can also result in a reduction in mass from striking face 309, an increased COR at the face center, an increased COR at an off-center location that is 7.5 mm toe-ward of the sweet spot, and an increased weighted COR. As another example variation, some implementations may not include one or more of upper region groove 418, toe region groove 426, lower region groove 422, or central region recess 420 or portions thereof, such as heel-side central region recess 435, middle central region recess 437, or toe-side central region recess 433.

In this regard, Table 5 below provides preferred striking face thicknesses and widths for recesses in variations of striking face 409 that do not include lower region groove 422, but still include heel-side central region recess 435, middle central region recess 437, toe-side central region 433, upper region groove 418, and toe-side region groove 426. All of the recesses in Table 5 below can have a radius of 0.4 mm between a bottom of the recess having the indicated thickness and an adjoining wall.

TABLE 5

| Club Head | Central Region Recess 420 | Upper Region Groove 418 | Toe Region Groove 426 | Lower Region Groove 422 |
|---|---|---|---|---|
| Club Head 1C | Middle Central Region 437 Thickness: 2.15 mm Heel-Side Central Region 435 Thickness: 1.95 mm Toe-Side Central Region 433 Thickness: 1.95 mm | Thickness: 1.75 mm Width: 6.5 mm | Thickness: 1.75 mm Width: 6.25 mm | None |
| Club Head 2C | Middle Central Region 437 Thickness: 2.00 mm Heel-Side Central Region 435 Thickness: 1.95 mm Toe-Side Central Region 433 Thickness: 1.95 mm | Thickness: 1.85 mm Width: 6.5 mm | Thickness: 1.85 mm Width: 2.5 mm | None |

Figure 9:
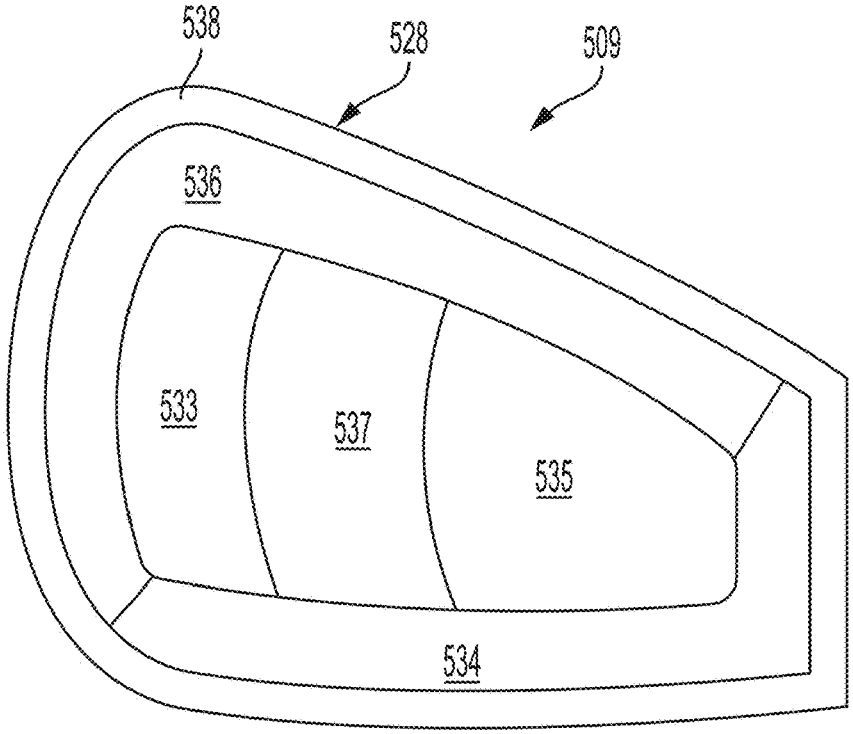
FIG. 9 depicts an exemplary rear surface of a striking face of a club head including a thickness pattern according to one or more embodiments.

FIG. 9 depicts exemplary rear surface 528 of striking face 509 including an example thickness pattern according to one or more embodiments. The thickness pattern of FIG. 9 includes regions or parameterization zones that have varying thicknesses, as opposed to the grooves discussed above that are surrounded by an intermediate region of greater average thickness. Striking face 509 may be formed, for example, of a steel material.

As shown in FIG. 9, rear surface 528 includes upper region 536, perimeter region 538, lower region 534, and central region 520, which includes toe-side central region portion 533, middle central region portion 537, and heel-side central region portion 535. The determination of thicknesses for these regions may be determined, for example, using an iterative process, such as the thickness pattern forming process of FIG. 11 discussed below. The thicknesses may provide for improved CORs (e.g., greater maximum COR and/or weighted COR), while maintaining a maximum striking face stress limit or range as a constraint so that striking face 509 is comparable to prior art club heads when tested for durability, despite a reduced mass of striking face 509.

In this regard, preferred thicknesses are provided in Table 6 below for the parameterization zones or regions shown in FIG. 9 for Club Head 1D, with resulting values for a stress limit for yielding (i.e., a von Mises stress for the striking face), weighted COR, maximum COR, and striking face mass shown in Table 7 below. Thicknesses for these regions are also provided below for a Comparable Club Head D in Table 6, with the resulting values for the stress limit, weighted COR, maximum COR, and striking face mass provided below in Table 7 for comparison. The thickness and width of perimeter region 538 for both Comparable Club Head D and Club Head 1D can be the same, such as with a thickness of 2.4 mm and a width of 2.5 mm, for example. The thicknesses provided below may vary between the regions, such as by tapering or with a stepwise transition. In some implementations, the thicknesses provided below may represent an average thickness for the region. In other implementations, the thicknesses provided below may represent a thickness at a center of the region.

TABLE 6

| Region Thickness | Comparable Club Head D | Club Head 1D |
|---|---|---|
| Middle Central Region 537 Thickness | 2.4 mm | 2.8 mm |
| Heel Central Region 535 Thickness | 2.5 mm | 2.4 mm |
| Toe Central Region 533 Thickness | 2.3 mm | 1.8 mm |
| Upper Region 536 Thickness | 2.2 mm | 1.8 mm |
| Lower Region 534 Thickness | 2.3 mm | 1.9 mm |

As shown above, the thicknesses across the striking face of Comparable Club Head D are nearly uniform with a small variation in thickness among the different regions. In contrast, middle central region 537 of Club Head 1D is much thicker than the other regions, and especially thicker than toe central region 535, upper region 536, and lower region 534. As shown in Table 7 below, such variations in the thickness of striking face 509 provide an increased weighted COR and an increased maximum COR, as compared to those of Comparable Club Head D. In addition, the variable thickness pattern of Club Head 1D also reduces the mass of striking face 509 by 6 g, while maintaining a similar or improved stress limit, and thereby providing a similar or greater durability than Comparable Club Head D. The removed or saved 6 g of mass from striking face 509 may be redistributed to other portions of the club head, such as to a rear muscle or toe portion to increase MOIs, and/or to better locate the CG and sweet spot for the club head, as discussed above.

TABLE 7

| Property | Comparable Club Head D | Club Head 1D |
|---|---|---|
| von Mises Stress | 1405 | 1472 |
| Weighted COR | 0.782 | 0.788 |
| Maximum COR | 0.822 | 0.825 |
| Striking Face Mass | 64 g | 58 g |

Those of ordinary skill in the art with reference to the present disclosure will appreciate that other implementations can include differently shaped or arranged regions or parameterization zones than those shown in the example of FIG. 9. In this regard, FIG. 10 provides a different thickness pattern with a different arrangement of regions or parameterization zones.

Figure 10:
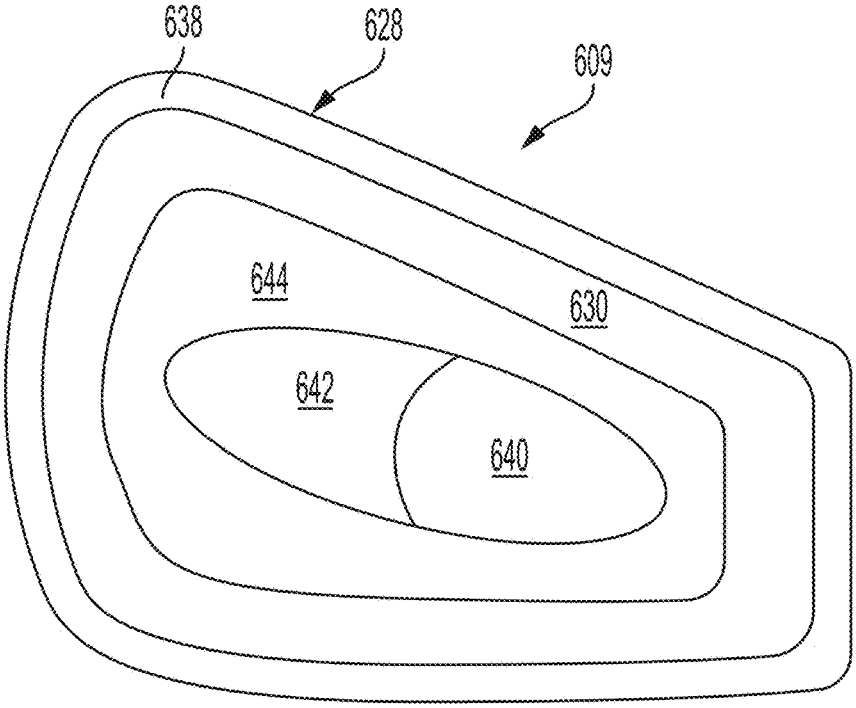
FIG. 10 depicts an exemplary rear surface of a striking face of a club head including a different thickness pattern according to one or more embodiments.

FIG. 10 depicts exemplary rear surface 628 of striking face 609 of a club head including a different thickness pattern according to one or more embodiments. As with the example thickness pattern of FIG. 9, the thickness pattern of FIG. 10 includes regions or parameterization zones that have varying thicknesses, as opposed to the grooves discussed above that are surrounded by an intermediate region of greater average thickness. Striking face 609 may be formed, for example, of a steel material.

As shown in FIG. 10, rear surface 628 includes perimeter region 638, outer region 630, and central region 620, which includes outer central region 644, toe-side inner central region 642, and heel-side inner central region 640. The determination of thicknesses for these regions may be determined, for example, using an iterative process, such as the thickness pattern forming process of FIG. 11 discussed below. The thicknesses may provide for improved CORs (e.g., greater maximum COR and/or weighted COR), while maintaining a striking face stress limit or range as a constraint so that striking face 609 is comparable to prior art club heads when tested for durability, despite a reduced mass of striking face 609.

In this regard, preferred thicknesses are provided in Table 8 below for the parameterization zones or regions shown in FIG. 10 for Club Head 1E and Club Head 2E, with resulting values for a stress limit for yielding (i.e., a von Mises stress for the striking face), weighted COR, maximum COR, and striking face mass shown in Table 9 below. The thickness and width of perimeter region 638 for both club heads can be the same, such as with a thickness of 2.4 mm and a width of 3.5 mm, for example. The thicknesses provided below may vary between the regions, such as by tapering or with a stepwise transition. In some implementations, the thicknesses provided below may represent an average thickness for the region. In other implementations, the thicknesses below may represent the thickness at a center location for the region.

TABLE 8

| Region Thickness | Club Head 1E | Club Head 2E |
|---|---|---|
| Outer Region 630 Thickness | 1.7 mm | 1.7 mm |
| Outer Central Region 644 Thickness | 2.2 mm | 2.3 mm |
| Toe-Side Inner Central Region 642 Thickness | 2.6 mm | 2.5 mm |
| Heel-Side Inner Central Region 640 Thickness | 2.6 mm | 2.6 mm |

As shown above, central region 620 is generally much thicker than outer region 630, with toe-side inner central region 642 and heel-side central region 640 being even thicker than outer central region 644. As shown in Table 7 below, such variations in the thickness of striking face 609 provide an increased weighted COR and an increased maximum COR, as compared to those of Comparable Club Head D discussed above with reference to Table 7. In addition, the variable thickness patterns of Club Heads 1E and 2E also reduce the mass of striking face 609 as compared to Comparable Club Head D by 6 g and 7 g, respectively, while maintaining a similar stress limit, and thereby providing a similar durability as Comparable Head D. The removed or saved 6 g or 7 g of mass from striking face 609 may be redistributed to other portions of the club head, such as to a rear muscle or toe portion to increase MOIs, and/or to better position the CG and sweet spot for the club head, as discussed above.

TABLE 9

| Property | Club Head 1E | Club Head 2E |
|---|---|---|
| von Mises Stress | 1448 | 1484 |
| Weighted COR | 0.782 | 0.788 |
| Maximum COR | 0.822 | 0.825 |
| Striking Face Mass | 64 g | 58 g |

Figure 11:
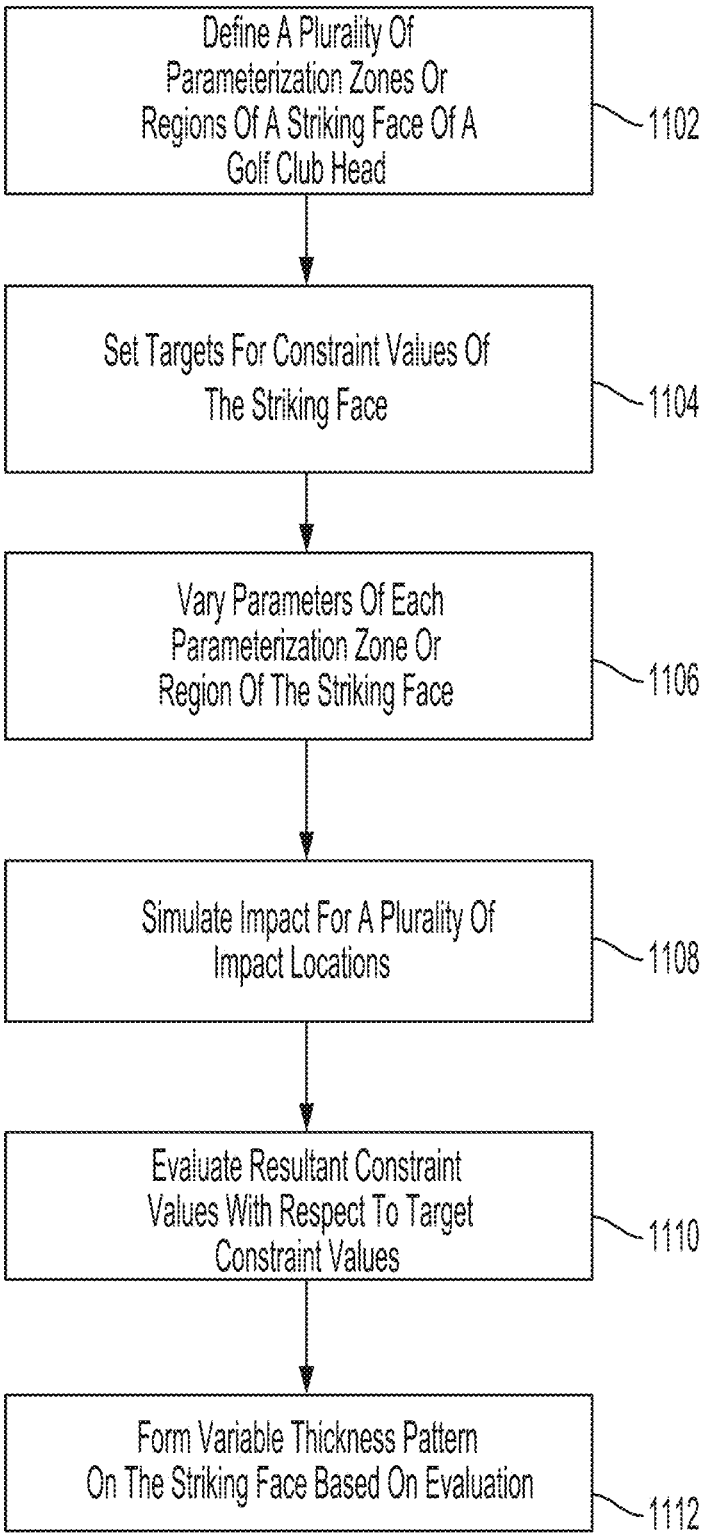
FIG. 11 is a flowchart for an example thickness pattern forming process for a striking face according to one or more embodiments.

FIG. 11 is a flowchart for an example thickness pattern forming process for a striking face according to one or more embodiments. The process of FIG. 11 may be used, for example, with the parameterization zones or regions shown in FIGS. 9 and 10 discussed above. A computing device or other electronic processing device may be used for determining the variable thickness pattern in some implementations.

In block 1102, a plurality of parameterization zones or regions are defined for a striking face of a club head. The club head can be formed with a club head body having a striking face, a heel portion, a toe portion opposite the heel portion, a sole, and a top portion opposite the sole. The club head may be formed, for example, of a steel material, and may include a hollow body type club head or a cavity-back type club head. Each parameterization zone or region may have a variable first parameter and a variable second parameter. In some implementations, the first and second parameters can include a thickness and a width, or other dimension of the parameterization zone or region.

In block 1104, a target value is set for each constraint value for the striking face. In some implementations, a first constraint value can be a striking face mass, a second constraint value can be a mechanical stress limit of the striking face, and a third constraint can be a weighted COR value for the striking face, as described above. The target value for each parameterization zone or region may be set, for example, based on desired improvements for the club head, such as an increased amount of discretionary mass to be redistributed from the striking face, an increased or minimum durability for the striking face, or an increased weighted COR that is balanced against rules for a maximum COR or CT set by a regulatory body.

In block 1106, the parameters of each parameterization zone or region are varied. For example, a maximum width and a thickness may be varied as parameters for each of a central region, upper region, lower region, and toe region of the striking face. In some implementations, the parameters may be iteratively varied to generate sets of values for the one or more constraint values based on the changes to the parameters.

In block 1108, impact with a golf ball is optionally simulated for a plurality of impact locations. In some implementations blocks 1106 and 1108 may be combined. For example, an impact probability matrix as in Table 3 above may be used with Equation 4 above to generate a weighted COR based on variations of first and second parameters for the parameterization zones or regions in block 1106.

In block 1110, constraint values resulting from the variation of parameters in block 1106 are evaluated with respect to the target value for one or more constraint values. For example, a resultant weighted COR value closest to 0.80 may at least in part determine the width and thicknesses of the parameterization zones or regions. As another example, a greatest mass removal or mass savings from the striking face may be another factor considered in determining a size and/or thickness of a parameterization zone or region.

In block 1112, a variable thickness pattern is formed on the striking face based on the evaluation in block 1110. In some cases, a rear surface of the striking face can have material removed using a cutting tool or other machining to form the variable thickness pattern. In other cases, the variable thickness pattern on the striking face may be formed by using a casting or forging process.

Those of ordinary skill in the art will appreciate with reference to the present disclosure that the thickness pattern forming process of FIG. 11 may differ in other implementations. For example, the setting of one or more targets for one or more corresponding constraint values in block 1104 may occur before the definition of parameterization zones or regions in block 1102. As another example variation, varying of parameters for each parameterization zone in block 1106 may be combined with the evaluation of resultant constraint values in block 1110. In some implementations, block 1108 may be omitted.

Figure 12:
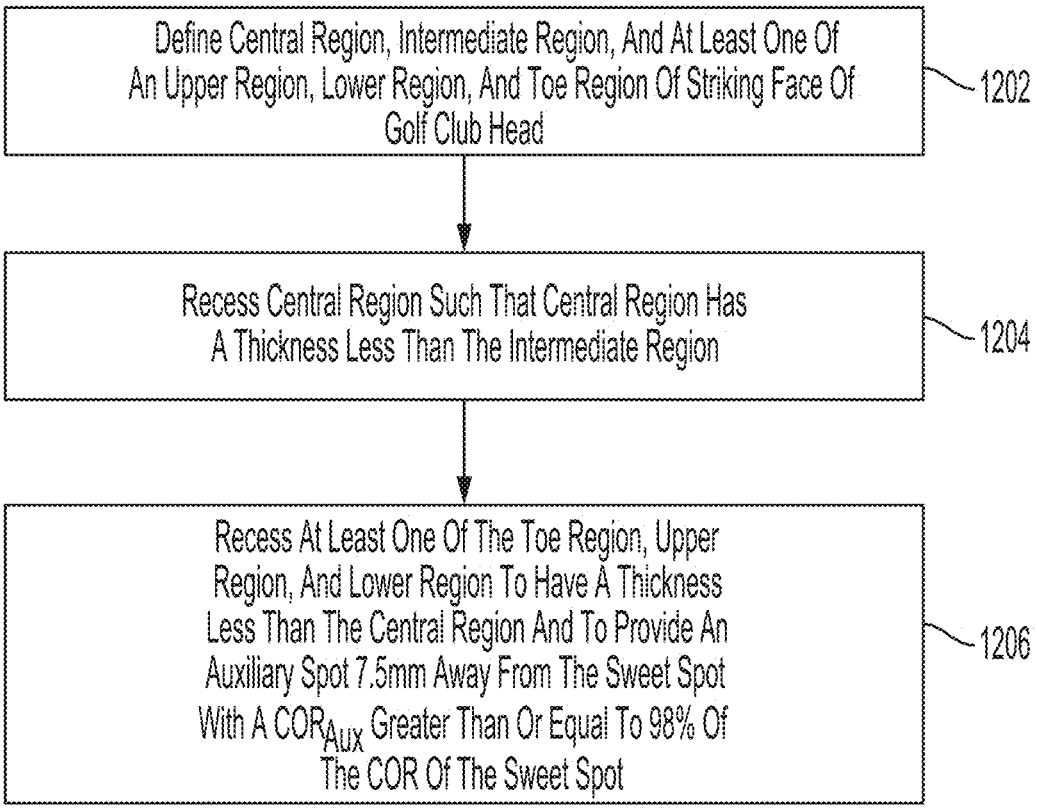
FIG. 12 is a flowchart for another example thickness pattern forming process for a striking face according to one or more embodiments

FIG. 12 is a flowchart for another example thickness pattern forming process for a striking face according to one or more embodiments. The process of FIG. 12 may be used, for example, with the parameterization zones or regions shown in FIGS. 7 and 8 discussed above. A computing device or other electronic processing device may be used for determining the variable thickness pattern in some implementations.

In block 1202, regions of a striking face of a club head are defined including a central region, an intermediate region, and at least one of an upper region, lower region, and toe region. The club head can be formed with a club head body having a striking face, a heel portion, a toe portion opposite the heel portion, a sole, and a top portion opposite the sole. The club head may be formed, for example, of a steel material, and may include a hollow body type club head or a cavity-back type club head. The central region includes a face center of the striking face, and the intermediate region at least partially surrounds the central region. The upper region can be located above the central region, and a lower region can be located below the central region. A toe region can be located toe-ward of the central region. The intermediate region can be disposed between the central region and each of, or at least one of, the upper region, lower region, and toe region.

In block 1204, the central region is recessed such that the central region has a thickness less than the intermediate region. In this regard, the intermediate region may have a uniform or approximately uniform thickness, such as a thickness of at least 2.5 mm and no more than 3.3 mm. The recess of the central region may be made by, for example, tapering the central region from a toe side of the central region to a heel side of the central region. In other implementations, the thickness of the central region may vary with stepwise changes in thickness to form the recess. The recess of the central region may be formed, for example, by machining to remove mass or by forging or casting at least a portion of the club head to save mass from the central region.

In block 1206, at least one of the toe region, upper region, and lower region is recessed, such as with a groove or channel, such that the recessed region has a thickness less than that of the central region. Such a groove may include, for example, an elongate groove having a width no less than about 2.0 mm in at least one of the toe region, upper region, and lower region. The groove may be formed, for example, by machining to remove mass or by forging or casting at least a portion of the club head to save mass from the at least one region. In some implementations, the upper region may include an elongate groove or channel having a width of no less than 6.0 mm.

The recess of the central region formed in block 1204 and the recess of at least one of the toe region, upper region, and lower region in block 1206 result in a striking face that includes a sweet spot corresponding to a first COR, COR1, and an auxiliary location spaced at least 7.5 mm from the sweet spot and corresponding to a second COR, $COR_{AUX}$, where COR2≥0.98*COR1. In this regard, the foregoing addition of recesses and corresponding removal of mass or mass savings from the striking face increases an area of the striking face that has a relatively high COR. In some implementations, a maximum COR for the striking face may also be increased or better positioned to correspond to a sweet spot and/or a more frequently hit portion of the striking face, as may be quantified with a weighted COR, as discussed above.

In addition, the removal or saving of mass from the striking face can also allow for redistribution of the mass in the club head, such as to a rear muscle or toe portion of the club head, so as to increase MOIs and/or better position the club head CG and striking face sweet spot. For example, a sweet spot may be located not more than 2.0 mm from a vertical center plane perpendicular to the face plane and extending through the face center. As another example, a CG for the club head may be located not more than 1.0 mm from the vertical center plane so as to better position the sweet spot on the face with an expected location or more frequently hit location.

Figure 13:
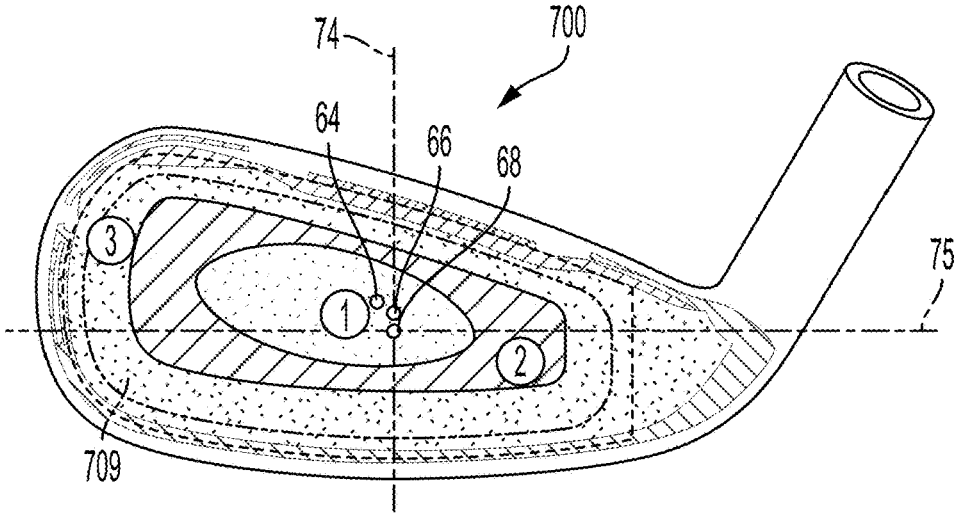
FIG. 13 is a front view of an exemplary golf club head with variable face thickness according to one or more embodiments.

FIG. 13 is a front view of an exemplary golf club head 700 with a variable face thickness according to one or more embodiments. As with the example striking faces 509 and 609 discussed above for FIGS. 9 and 10, golf club head 700 in FIG. 13 includes a striking face 709 having a variable thickness with regions or parameterization zones that have varying thicknesses. Striking face 709 may be formed, for example, of a steel material, a titanium alloy, or a composite material, and may include a face insert as discussed above. In some implementations, the face insert may include a material different from a shell of the golf club head (i.e., shell 703 shown in FIG. 14).

As shown in FIG. 13, striking face 709 includes a center region denoted with an encircled 1, an intermediate region denoted with an encircled 2 surrounding the center region, and a perimeter region denoted with an encircled 3 surrounding the intermediate region. In the example of FIG. 13, the center region has a first substantially uniform thickness T1, the intermediate region has a second substantially uniform thickness T2, and the perimeter region has a third substantially uniform thickness T3. In some implementations, a maximum thickness of the striking face 709 is located in the perimeter region. In addition, the relationship between the thicknesses of the regions may satisfy $T2<T1<T3$. Preferred thicknesses for T1, T2, and T3 in such implementations can include T1=2.1 mm, T2=1.7 mm, and T3=2.3 mm. For these thicknesses, the face comprises a material having a density no less than 7.5 g/cm$^3$ and no more than 8.25 gm/cm$^3$.

The thicknesses and shapes of the center region, the intermediate region, and the perimeter region can be determined using, for example, a thickness pattern forming process as discussed above for FIG. 11. In such processes, a computing device or other electronic processing device may be used for determining the variable thickness pattern by using a COR and/or a weighted COR for the striking face as a target value for evaluated constraint values that result from varying thicknesses and/or other dimensions of the center, intermediate, and perimeter regions for simulated ball impacts.

In one example resulting from such a thickness pattern forming process, a simulated weighted COR was increased from 0.696 for a striking face with a uniform face thickness of 2.3 mm to a simulated weighted COR of 0.720 with the varying thicknesses of T1, T2, and T3 of the center, intermediate, and perimeter regions provided above for striking face 709. In addition, the maximum simulated COR for the striking face of uniform thickness 2.3 mm was increased in this example with the varying thicknesses of T1, T2, and T3 of the center, intermediate, and perimeter regions provided above for striking face 709. In implementations where golf club head 700 forms part of a set of iron-type golf clubs, some or all of the golf club heads in the set can have a weighted COR of at least 0.70 determined using the probability matrix of Table 3 above and Equation 4.

As shown in FIG. 13, striking face 709 includes face center 64 and sweet spot 66, which as defined above, corresponds to a normal projection of CG 68 onto the striking face 709. Herein, the distance from the CG to the sweet spot is referred to as the CG depth. A virtual vertical CG axis 74 and a virtual horizontal CG axis 75 intersect at the CG 68. As discussed in more detail below with reference to FIGS. 15 to 21, golf club head 700 includes an internal weight pad located on a lower portion of a shell of golf club head 700 that can be positioned and sized to modify the golf club head's mass properties such as CG location and MOIs. As with the thickness pattern forming processes for determining face thicknesses and shapes of regions of a variable thickness striking face, the shape and distribution of mass of the internal weight pad can be determined with an iterative process to approach or improve target values for constraints such as MOIs, a maximum stress, and a CG location, which may locate the sweet spot closer to a face center on the striking face, for example.

Figure 14:
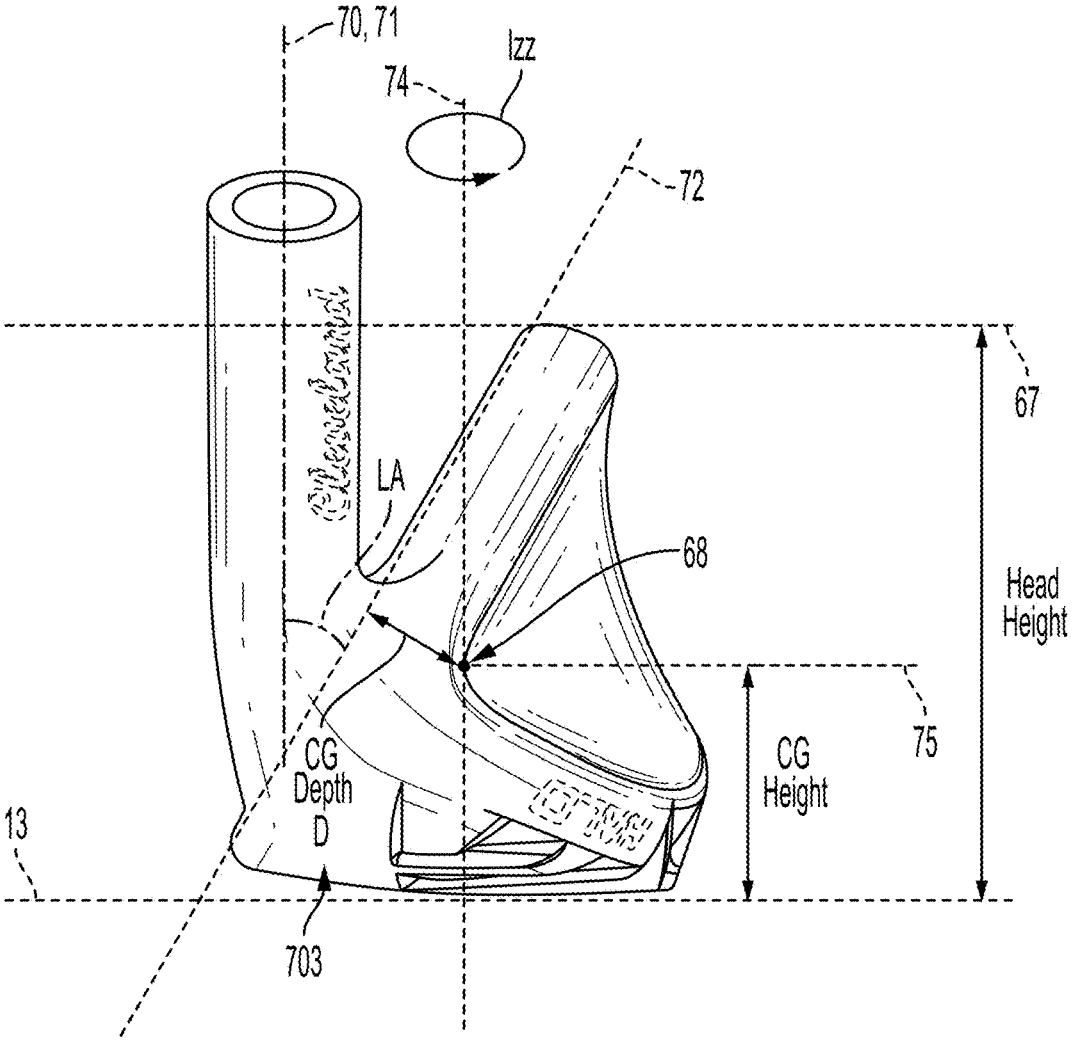
FIG. 14 is a heel view of an exemplary golf club head with a shell according to one or more embodiments.

FIG. 14 is a heel view of golf club head 700 with shell 703 according to one or more embodiments. As shown in FIG. 14, golf club head 700 has a Loft Angle (LA) defined between face plane 72 and virtual vertical hosel plane 71, which includes hosel axis 70 that extends axially through the center of the hosel of golf club head 700. Golf club head 700 is shown orientated in a reference position with virtual vertical hosel plane 71 normal to ground plane 13 for impacting a golf ball. As discussed in more detail below, golf club head 700 can form part of a set of iron-type golf clubs where each golf club of the set includes a golf club head with a loft (i.e., loft angle LA) of at least 20 degrees and where at least two of the golf club heads in the set have a difference in LA of at least 5 degrees. In some cases, the set of such iron-type golf clubs can comprise a set of "hollow irons" or "game improvement" irons intended to be more forgiving for off-center shots.

The CG depth D of golf club head 700 is measured perpendicularly from face plane 72 to CG 68, which is at an intersection of virtual vertical CG axis 74 and virtual horizontal CG axis 75. As shown in FIG. 14, CG 68 is located at a CG height that is closer to ground plane 13 than to topline plane 77 defining an overall head height. Preferably, the CG depth can be located using the redistribution of mass from striking face 709 and/or the redistribution of mass for an internal weight pad such that the CG depth D satisfies the equation:

$$D=a-b*LA, \qquad \text{Equation 3}$$

with 19 mm<a<22 mm and b=0.36 mm/degrees, and more preferably, with 20 mm<a<21 mm and b=0.36 mm/degrees. In implementations where golf club head 700 forms part of a set of iron-type golf club heads, each club head in the set can satisfy Equation 3 above, with 19 mm<a<22 mm and b=0.36 mm/degrees, and with at least two golf club heads in the set having a value for a within 20 mm<a<21 mm. The shape and mass distribution of the internal weight pad can be used to precisely tune properties, such as CG depth, for each club in the set. In this regard, a deeper CG depth (i.e., a greater value for D in Equation 3 above) can provide an improved accuracy on mishits or off-center shots, resulting in a more forgiving club head; a higher CG depth may therefore be more desirable in a lower lofted golf club head.

In addition, the redistribution of mass from striking face 709 and/or the redistribution of mass for an internal weight pad can provide an MOI about virtual vertical CG axis 74 (i.e., Izz in FIG. 14) that is at least 2900 g*cm$^2$. In implementations where golf club head 700 forms part of a set of iron-type golf clubs, at least two of the golf club heads in the set preferably have an MOI about a vertical axis through the center of gravity of the golf club head that is at least 2900 g*cm$^2$. The shapes and distributions of mass for the internal weight pads of different iron-type golf clubs in a set can vary to satisfy Equation 3 above and/or meet other target values such as an MOI about the virtual vertical CG axis (i.e., Izz) of at least 2900 g*cm$^2$ and/or an MOI about the virtual horizontal CG axis parallel to a face plane (i.e., Ixx) of at least 900 g*cm$^2$.

Figure 15:
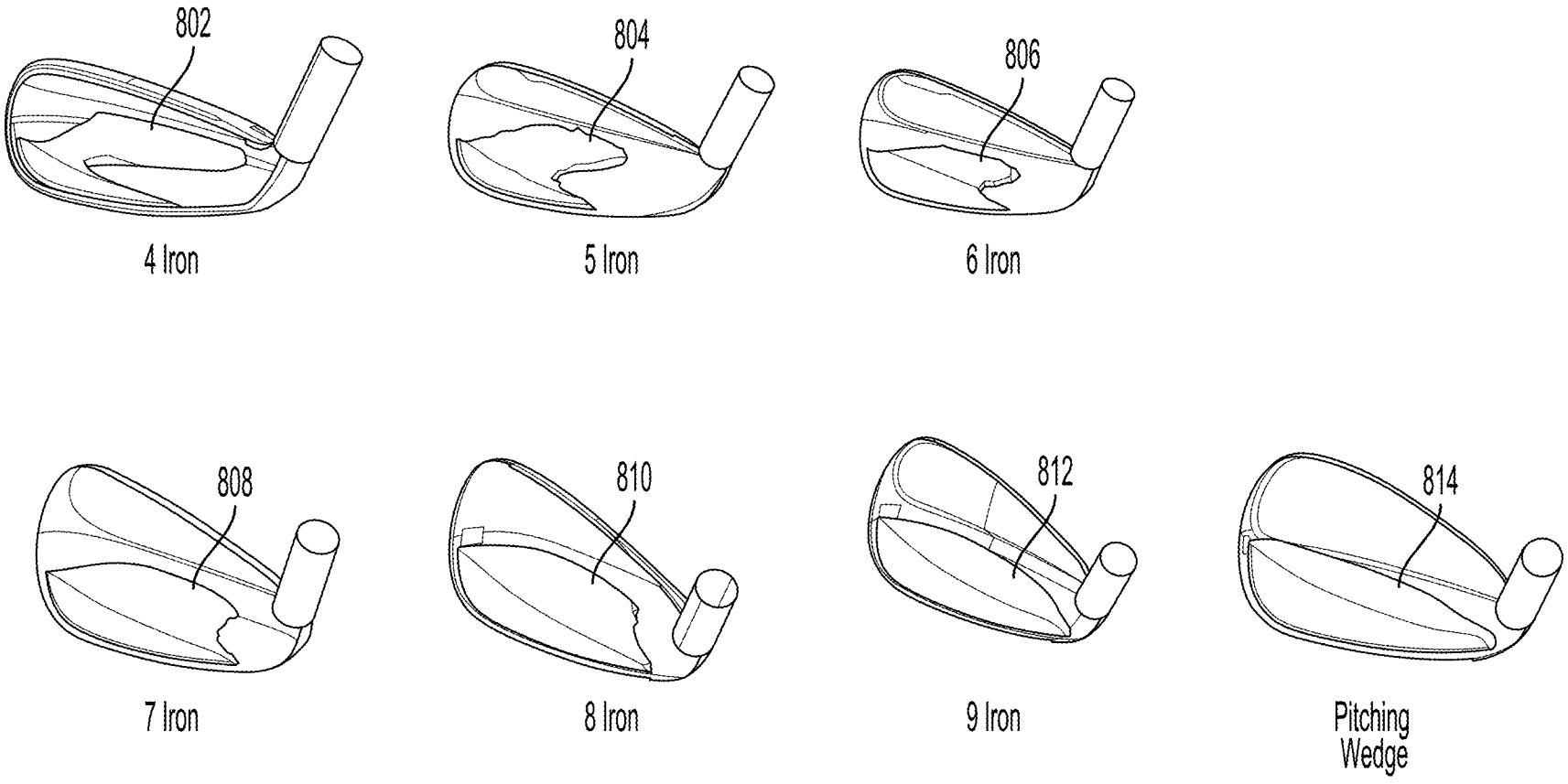
FIG. 15 depicts exemplary golf club heads from a golf club set including internal weight pads according to one or more embodiments.

In this regard, FIG. 15 depicts exemplary golf club heads from a golf club set including differently shaped internal weight pads according to one or more embodiments. The internal weight pads can be integrally formed with the shell of the club heads or may be a separate, higher-density component. In cases where the weight pad is integrally formed with a shell of the golf club head, the weight pad can be defined as the portion of the sole portion or lower portion of the shell that has a thickness greater than a generally constant baseline or minimum lower shell or sole thickness. In some implementations, the internal weight pads and the shell can comprise a unitary investment casted component. As shown in FIG. 15, the shapes and sizes of internal weight pads 802, 804, 806, 808, 810, 812, and 814 vary for the different iron-type club heads in the set. The varying shapes and mass distributions of the weight pads allow for an individualized or tailored positioning of the CG (e.g., CG depth) for each of the golf club heads in the set, which each have different mass properties due in part to the different sizes and loft angles of the golf club heads in the set.

As shown in FIG. 15, the internal weight pads extend proximate from the face-toe rear boundary of the sole toward the hosel bore, such that the internal weight pads are spaced from the hosel bores. The shapes and mass distributions of the weight pads in FIG. 15 may be determined using an iterative process similar to the face thickness pattern forming process of FIG. 11 described above where dimensional parameters for the weight pad are varied to meet or approach a target value for the golf club head. The result of such design processes can produce "organically shaped" or amorphous weight pads substantially on the lower portion of the shell, as shown by the weight pads in FIG. 8. As shown in the example of FIG. 8, internal weight pads 802 and 804 for the lower lofted or long iron golf club heads (i.e., the 4 iron and the 5 iron) comprise a U-shape concavity or recess that becomes less pronounced with reduced concavity in weight pads 806 and 808 for the mid-lofted or mid-iron golf club heads (i.e., the 6 iron and the 7 iron).

FIG. 15 also shows how the mass of the internal weight pads shifts more toward the heel region as the loft of the club heads increase. For example, internal weight pads 812 and 814 for the 9 iron and the pitching wedge extend farther toward the hosel bore in the heel region than internal weight pads 802 and 804 for the 4 iron and the 5 iron. In this regard, the weight pads of the lower lofted golf club heads (e.g., weight pads 802 and 804) have a CG located more toe-ward of the overall golf club head CG than the weight pads of the higher lofted golf club heads (e.g., weight pads 812 and 814). In the example of FIG. 15, all of the CGs of the weight pads may be located toe-ward of their respective overall golf club head CGs, but the CGs for the weight pads of the lower lofted golf club heads (e.g., weight pads for the 4 iron, 5 iron, and 6 iron) are located more toe-ward than the CGs for the weight pads of the higher lofted golf club heads (e.g., weight pads for the 7 iron, 8 iron, 9 iron, and pitching wedge).

Figure 16:
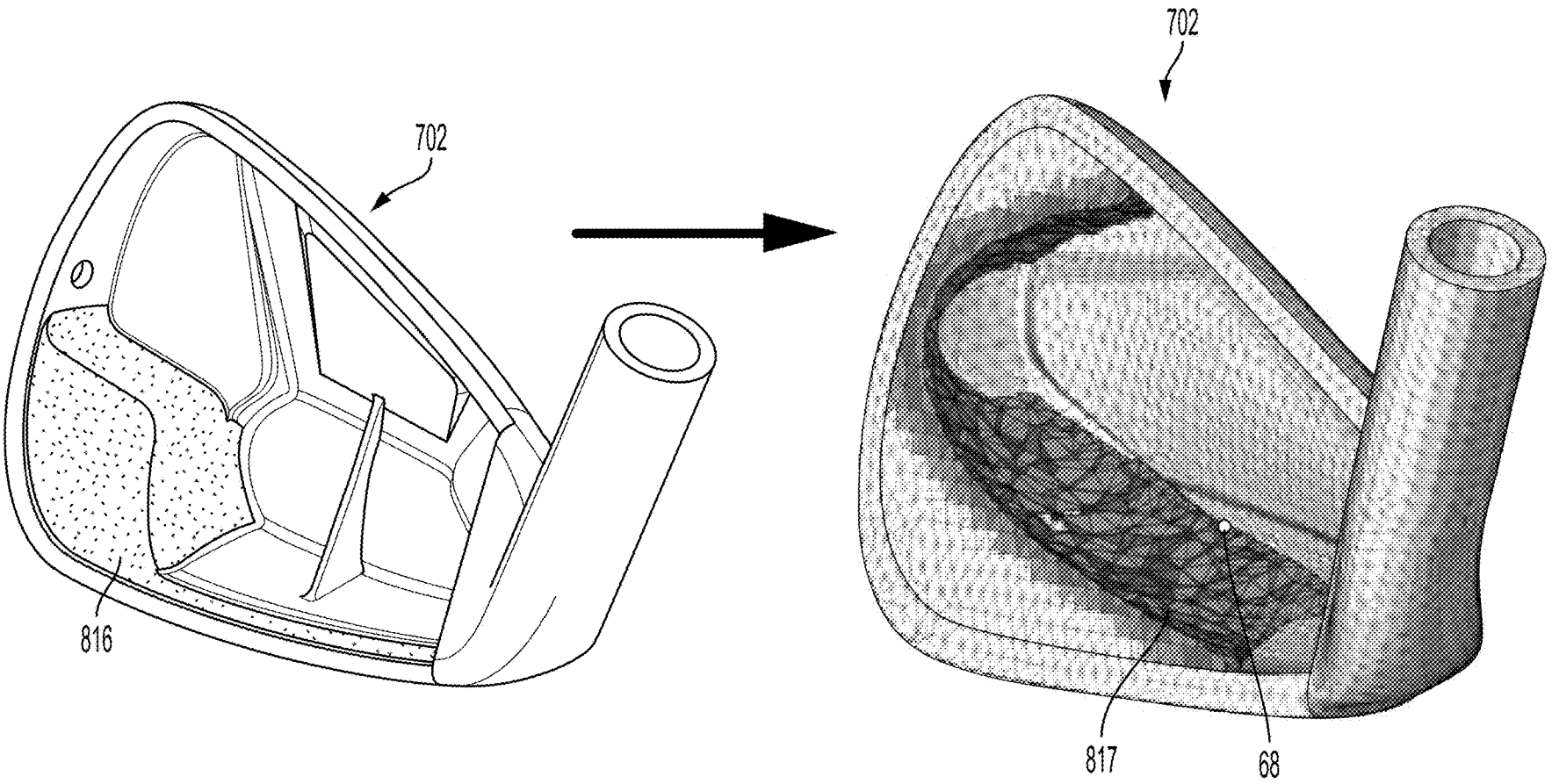
FIG. 16 depicts the results of an iterative weight pad shaping process for a golf club head according to one or more embodiments.

FIG. 16 depicts the results of an iterative weight pad reshaping process for a golf club head according to one or more embodiments. The internal view of golf club head 702 in FIG. 16, which may correspond to an internal view of the golf club head 702 shown in FIGS. 13 and 14 discussed above, shows an initial internal weight pad 816 on the left side of FIG. 16 that has been reshaped using the same amount of mass into the organically shaped, internal weight pad 817 for golf club head 702 on the right side of FIG. 16. In the example of FIG. 16, internal weight pad 817 is substantially located on the lower portion of the shell of golf club head 702 with a smaller portion of internal weight pad 817 extending onto an upper portion of the shell of golf club head 702. In addition, internal weight pad 817 is located substantially toe-ward of CG 68. In cases where internal weight pad 817 is integrally formed with the shell of the golf club head, the weight pad 817 can be defined as the portion of the sole portion or lower portion of the shell that has a thickness greater than a generally constant baseline or minimum lower shell or sole thickness.

As discussed above, weight pad 816 may be reshaped into weight pad 817 using a computing device or other electronic processing device to determine a mass distribution for the weight pad using target values for constraints such as Izz, Ixx, maximum stress, and/or CG location (e.g., CG depth, CG height, and/or relation of sweet spot to striking face center). In some implementations, a topology optimization software, such as Altair's OptiStruct, may be used with a design space of the mesh internal volume of club head 702 as partially shown on the right side of FIG. 16. The topology optimization can iteratively determine a mass distribution for the weight pad within the mesh internal volume to maximize or improve a target value for constraints such as Izz, Ixx, maximum stress, and/or CG location (and the resulting sweet spot location).

Figure 17:
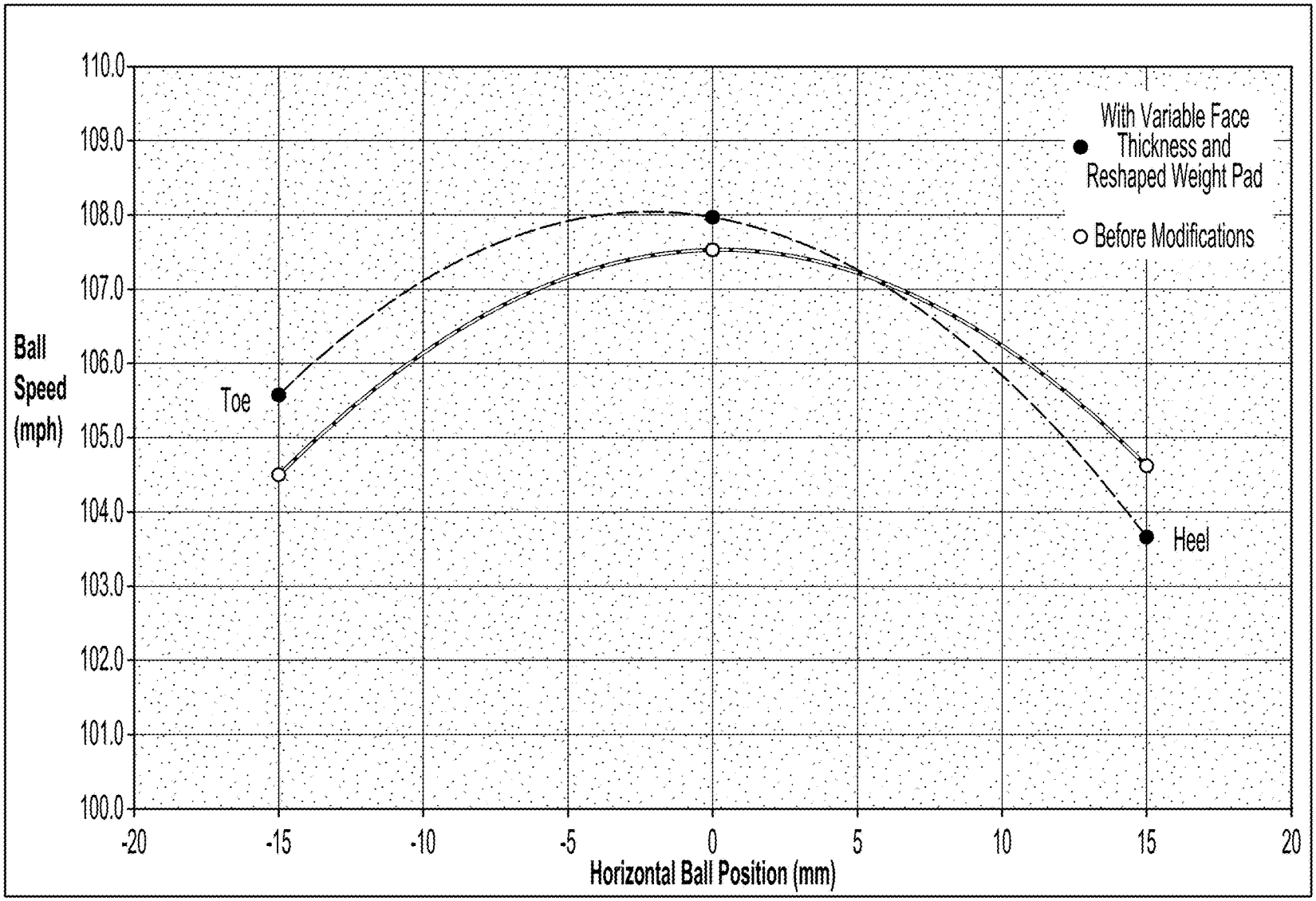
FIG. 17 shows test results for ball speed for impacts across the face of a golf club head with a variable face thickness and iteratively reshaped weight pad according to one or more embodiments.

FIG. 17 shows test results for ball speed for different impact locations across the face of a golf club head with a variable face thickness pattern and an organically shaped internal weight pad according to one or more embodiments. The golf club head of a 6 iron was modified to include a variable face thickness pattern and reshaped internal weight pad using iterative processes as discussed above. The unmodified or original version of the 6 iron golf club head was tested with robotic hits horizontally across the striking face to result in the first dashed line indicating ball speed relative to horizontal impact location across the striking face. The modified version of the 6 iron golf club head including the variable face thickness pattern and reshaped weight pad was similarly tested to result in the second dashed line indicating ball speed relative to horizontal impact location across the striking face of the modified golf club head.

As shown in FIG. 17, the modified golf club head resulted in faster ball speeds for impacts on the toe-side of the striking face, which results in the ball travelling farther for impacts on the toe-side of the striking face as compared to the unmodified golf club head. This improvement helps most golfers since player test data shows that most off-center shots tend to be on the toe-side of the striking face. The tendency for toe-side, off-center shots is also reflected in the probability matrix of Table 3 above for determining a weighted COR.

Figure 18:
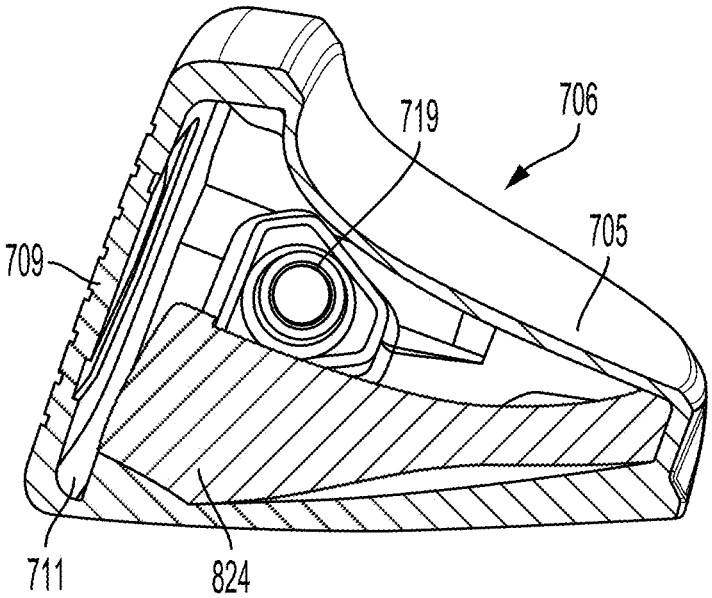
FIG. 18 is a cross-section view of a four iron golf club head including a weight pad according to one or more embodiments.

FIG. 18 is a cross-section view of a four iron golf club head 706 including an internal weight pad 824 according to one or more embodiments. As shown in FIG. 18, striking face 709 includes a variable thickness face insert. In addition, internal weight pad 824 is entirely spaced apart from striking face 709 with a heel-toe channel 711. In some implementations, a width of heel-toe channel 711 between striking face 709 and internal weight pad 824 may range between 2 mm and 4 mm.

Shell 705 includes a crown, a sole opposite the crown, a heel, a toe, and an internal weight pad 824 located on a lower portion of the shell 705. Internal weight pad 824 may be integrally formed with the shell 705 or may comprise a separate component. Weight pad 824 can be defined as the portion of the sole portion or lower portion of shell 705 that has a thickness greater than a generally constant baseline or minimum lower shell or sole thickness. The weight pad thickness is then the total lower wall thickness minus the baseline or minimum lower shell or sole thickness. As shown in FIG. 18, internal weight pad 824 has a varying thickness in a leading edge to trailing edge direction.

In addition, golf club head 706 includes a weight port that receives removable weight 719 on a toe portion of the golf club head. The removable weight 719 can be used to provide further mass property customization or improvement, such as to adjust MOIs, CG locations, and/or swing weight of the golf club.

Figure 19:
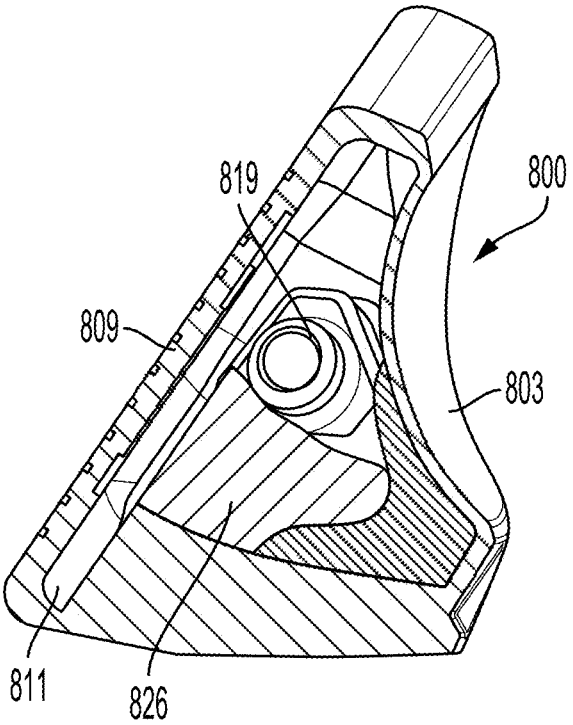
FIG. 19 is a cross-section view of an eight iron golf club head including a weight pad according to one or more embodiments

FIG. 19 is a cross-section view of an eight iron golf club head 800 including an internal weight pad 826 according to one or more embodiments. As shown in FIG. 19, striking face 809 includes a variable thickness face insert. In addition, internal weight pad 826 is entirely spaced apart from striking face 809 with a heel-toe channel 811. In some implementations, a width of heel-toe channel 811 between striking face 809 and internal weight pad 826 may range between 2 mm and 4 mm.

Shell 803 includes a crown, a sole opposite the crown, a heel, a toe, and internal weight pad 826 located on a lower portion of the shell 803. Internal weight pad 826 may be integrally formed with the shell 803 or may comprise a separate component. Weight pad 826 can be defined as the portion of the sole portion or lower portion of shell 803 that has a thickness greater than a generally constant baseline or minimum lower shell or sole thickness. The weight pad thickness is then the total lower wall thickness minus the baseline or minimum lower shell or sole thickness. As shown in FIG. 19, internal weight pad 826 has a varying thickness in a leading edge to trailing edge direction.

In addition, golf club head 800 includes a weight port that receives removable weight 819 on a toe portion of the golf club head. The removable weight 819 can be used to provide further mass property customization or improvement, such as to adjust MOIs, CG locations, and/or swing weight of the golf club.

Figure 20:
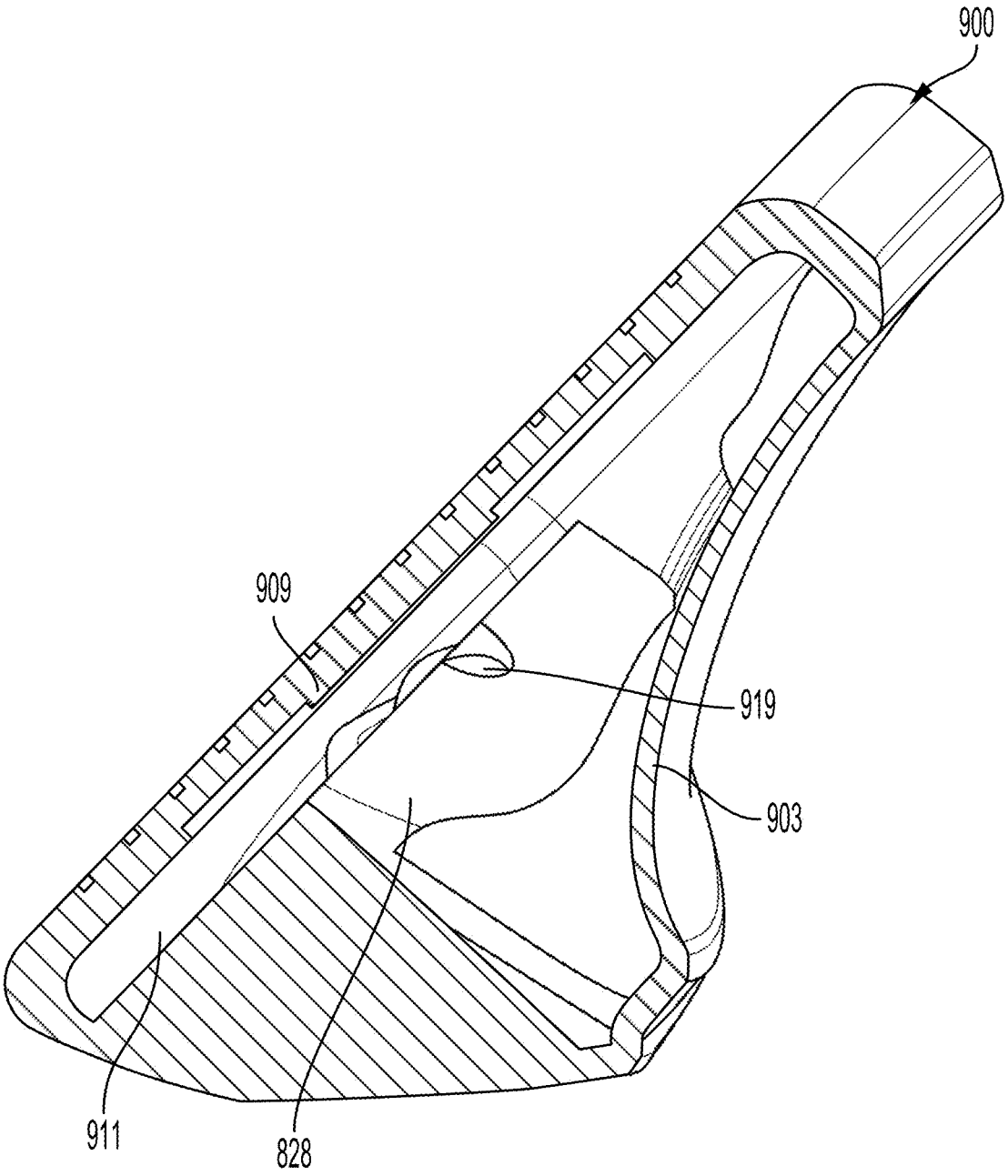
FIG. 20 is a cross-section view of a pitching wedge golf club head including a weight pad according to one or more embodiments.

FIG. 20 is a cross-section view of a pitching wedge golf club head 900 including an internal weight pad 828 according to one or more embodiments. As shown in FIG. 20, striking face 909 includes a variable thickness face insert. In addition, internal weight pad 828 is entirely spaced apart from striking face 909 with a heel-toe channel 911. In some implementations, a width of heel-toe channel 911 between striking face 909 and internal weight pad 828 may range between 2 mm and 4 mm.

Shell 903 includes a crown, a sole opposite the crown, a heel, a toe, and internal weight pad 828 located on a lower portion of the shell 903. Internal weight pad 828 may be integrally formed with the shell 903 or may comprise a separate component. Weight pad 828 can be defined as the portion of the sole portion or lower portion of shell 903 that has a thickness greater than a generally constant baseline or minimum lower shell or sole thickness. The weight pad thickness is then the total lower wall thickness minus the baseline or minimum lower shell or sole thickness. As shown in FIG. 20, internal weight pad 828 has a varying thickness in a leading edge to trailing edge direction.

In addition, golf club head 900 includes a weight port that receives removable weight 919 on a toe portion of the golf club head. The removable weight 919 can be used to provide further mass property customization or improvement, such as to adjust MOIs, CG locations, and/or swing weight of the golf club.

Figure 21A:
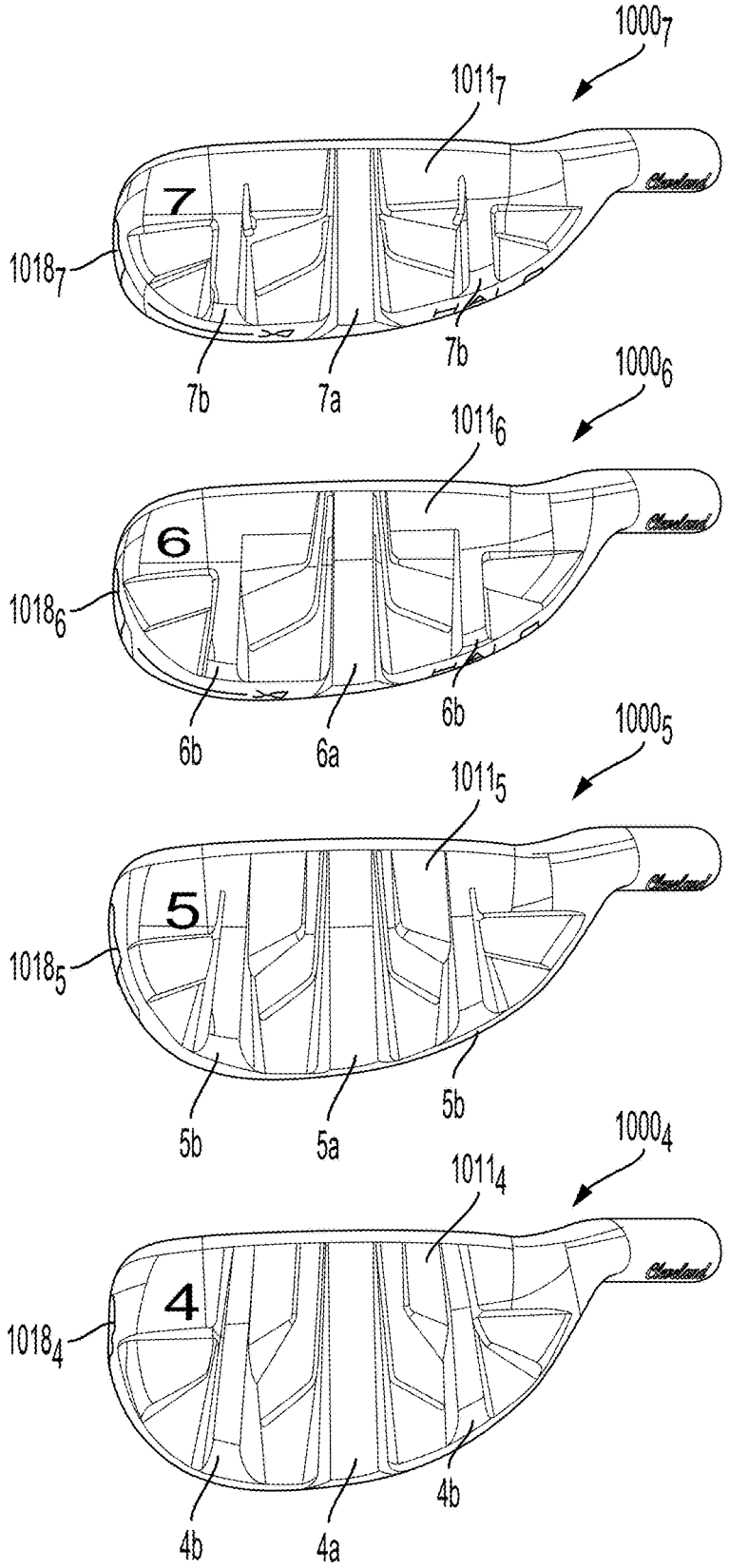
FIG. 21A provides bottom views of long and mid-iron golf club heads according to one or more embodiments.
Figure 21B:
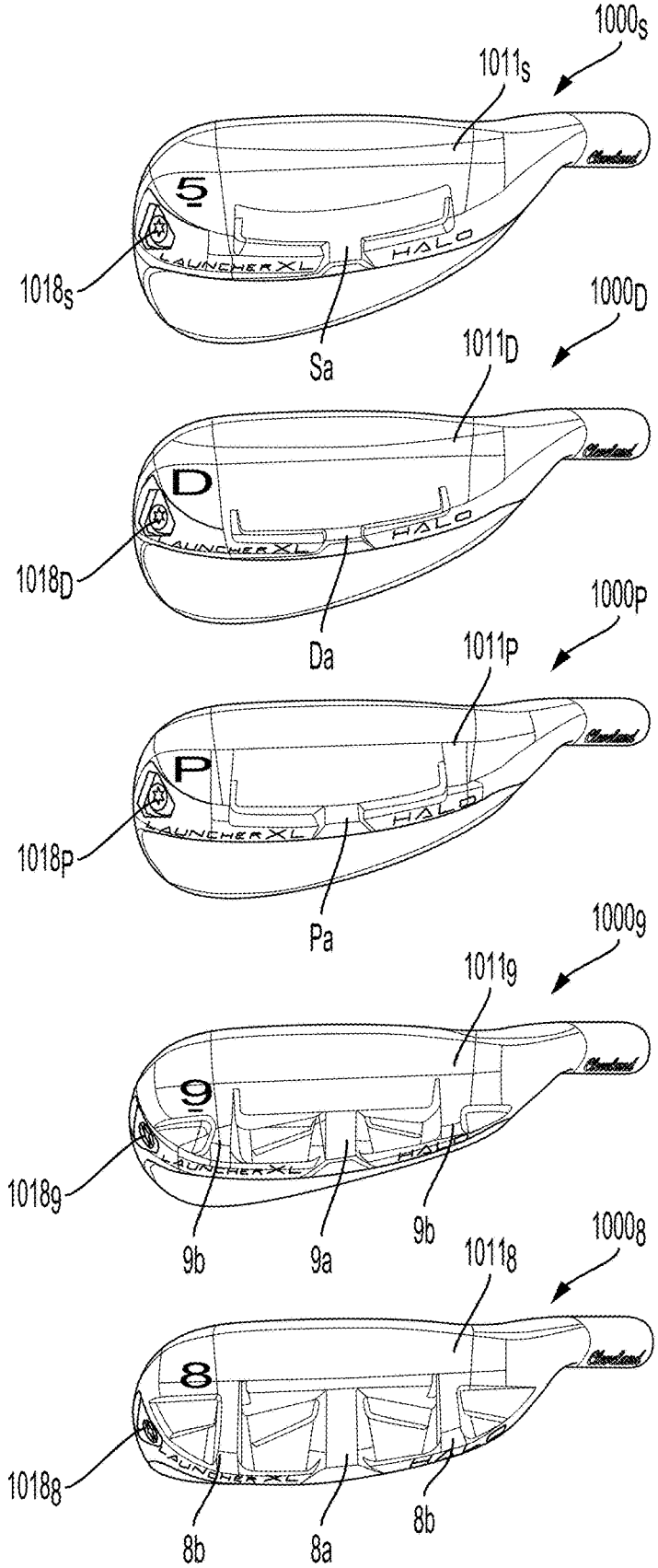
FIG. 21B provides bottom views of mid-iron and short iron golf club heads according to one or more embodiments FIG. 22 provides perspective bottom views of a long iron golf club head, a mid-iron golf club head, and a short iron golf club head according to one or more embodiments.

FIGS. 21A and 21B provide bottom views of long golf club heads, mid-iron golf club heads, and short iron golf club heads according to one or more embodiments. The golf club heads shown in FIGS. 21A and 21B can form part of a set of iron-type golf clubs with each golf club head in the set having a striking face with a variable thickness and an internal weight pad, a loft angle LA of at least 20 degrees, and a CG depth D satisfying Equation 3 above, with 19 mm<a<22 mm and b=0.36 mm/degrees. At least two of the golf club heads shown in FIGS. 21A and 21B have a difference in loft angle LA of at least 5 degrees. In addition, at least two of the golf club heads in the set have an Izz that is at least 2900 g*cm $cm^2$ and/or an Ixx of at least 900 g*$cm^2$.

As shown in FIG. 21A, the long iron golf club heads (i.e., golf club heads $\mathbf{1000}_4$ and $\mathbf{1000}_5$ for a four iron golf club and a five iron golf club) each include three sole rails 4*a* and 4*b* or 5*a* and 5*b* that extend across more than half of a total sole width between a leading edge and a trailing edge. The center sole rails 4*a* and 5*a* extend from proximate the face (e.g., about 3 mm rearward of the leading edge of the sole) across a fuller width of soles $\mathbf{1011}_4$ and $\mathbf{1011}_5$ than the outer sole rails 6*b* and 7*b* of the mid-iron golf club heads (i.e., golf club heads $\mathbf{1000}_6$ and $\mathbf{1000}_7$ for a six iron golf club and a seven iron golf club). In the example set of FIGS. 21A and 21B, the center sole rails 4*a* and 5*a* of the long iron golf club heads $\mathbf{1000}_4$ and $\mathbf{1000}_5$, as well as the center sole rails 6*a* and 7*a* of the mid-iron golf club heads $\mathbf{1000}_6$ and $\mathbf{1000}_7$, extend almost fully across their respective soles. In the case of mid-iron golf club heads $\mathbf{1000}_6$ and $\mathbf{1000}_7$, however, outer sole rails 6*b* and 7*b* stop well short of the leading edge or striking face.

The lengths of the sole rails across the sole widths generally become shorter as the loft of the golf club heads increase with increasingly shorter sole rails 8*a* and 8*b* for golf club head $\mathbf{1000}_8$ across sole $\mathbf{1011}_8$, and sole rails 9*a* and 9*b* for golf club head $\mathbf{1000}_9$ across sole $\mathbf{1011}_9$. In this regard, outer sole rails 8*b* and 9*b* stop at or before reaching halfway across the sole from the trailing edge to the leading edge. For short-iron golf club heads 1000P, 1000D, and 1000S for a pitching wedge club, a dual wedge club, and a sand wedge club, only relatively short center sole rails Pa, Da, and Sa remain proximate the trailing edge (e.g., within 3 mm forward of the trailing edge). In addition, and as discussed in more detail below with reference to FIGS. 22 and 24, some or all of the short iron golf club heads, such as for the pitching wedge, dual wedge, and sand wedge, can include a V-shaped sole.

The foregoing arrangement of sole rails can provide for different ground interface effects related to the different angles of attack during a downswing of clubs in the set having different club lengths. For example, the varying sole rails depicted in the set shown in FIGS. 21A and 21B can help reduce a loss in club head speed when contacting turf and prevent "chunked" shots. In addition, the use of a V-shaped sole can help move through turf or sand when using higher lofted golf club heads having a steeper angle of attack.

FIGS. 21A and 21B also depict removable weights 1018 on a toe portion of each of the golf club heads in the set (i.e., removeable weights $\mathbf{1018}_4$, $\mathbf{1018}_5$, $\mathbf{1018}_6$, $\mathbf{1018}_7$, $\mathbf{1018}_8$, $\mathbf{1018}_9$, $\mathbf{1018}_P$, $\mathbf{1018}_D$, and $\mathbf{1018}_S$). As noted above, such removable weights can provide further mass property customization or improvement, such as to adjust MOIs, CG locations, and/or swing weight of the golf club.

Figure 22:
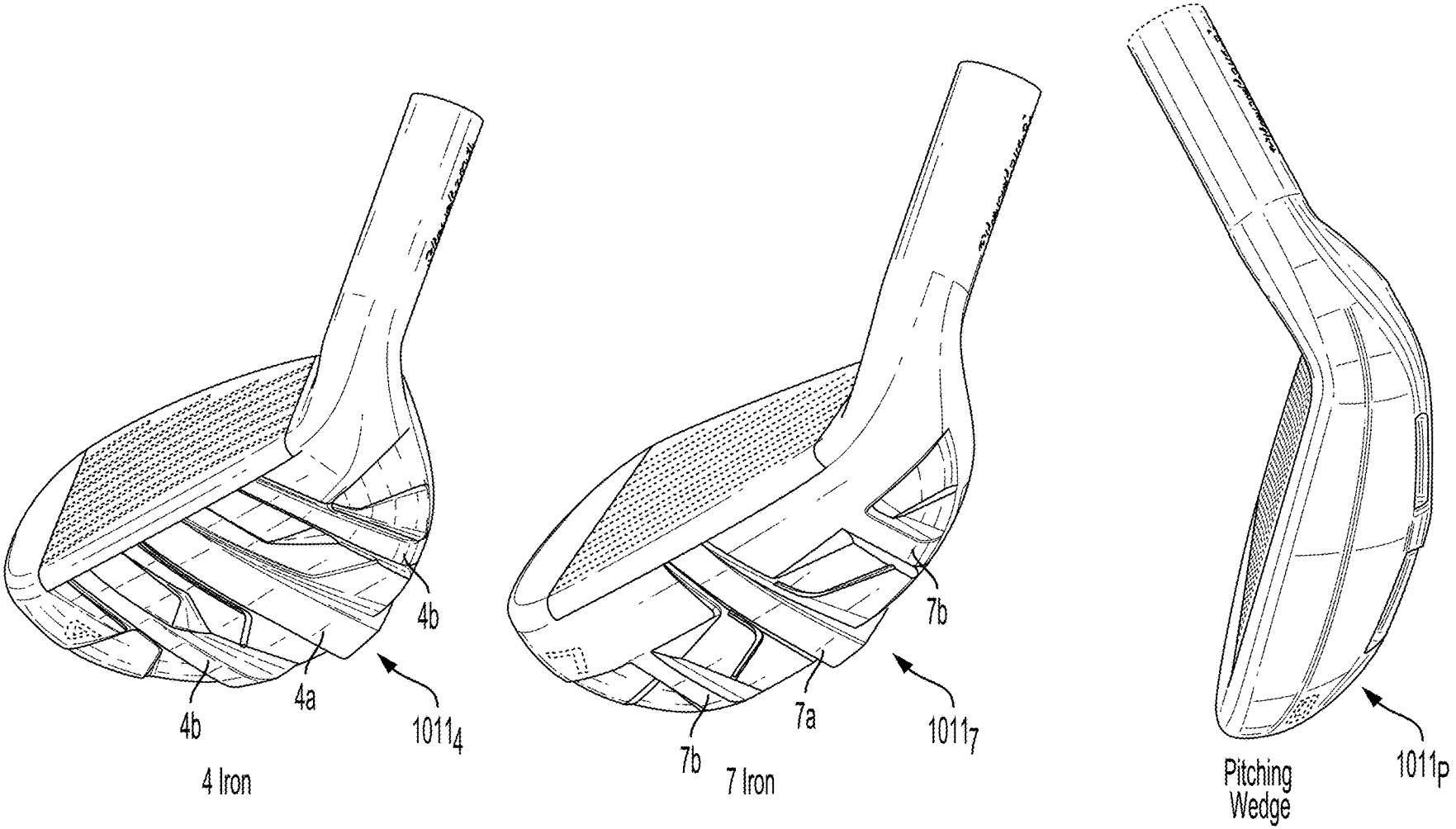

FIG. 22 provides perspective bottom views of a long iron golf club head, a mid-iron golf club head, and a short iron golf club head according to one or more embodiments. As shown in FIG. 22, sole $\mathbf{1011}_4$ of the long iron golf club head includes center sole rail 4A and outer sole rails 4*b* extending across approximately a full width of the sole $\mathbf{1011}_4$. Sole $\mathbf{1011}_7$ of the mid-iron golf club head includes center sole rail 7*a* extending across approximately the full width of sole $\mathbf{1011}_7$, but with outer sole rails 7*b* only extending partially across the full width of sole $\mathbf{1011}_7$. Sole $\mathbf{1011}_P$ of the short iron golf club head does not have any sole rails extending across an approximate full width of the sole $\mathbf{1011}_P$, but instead includes a V-shaped sole.

Figure 23:
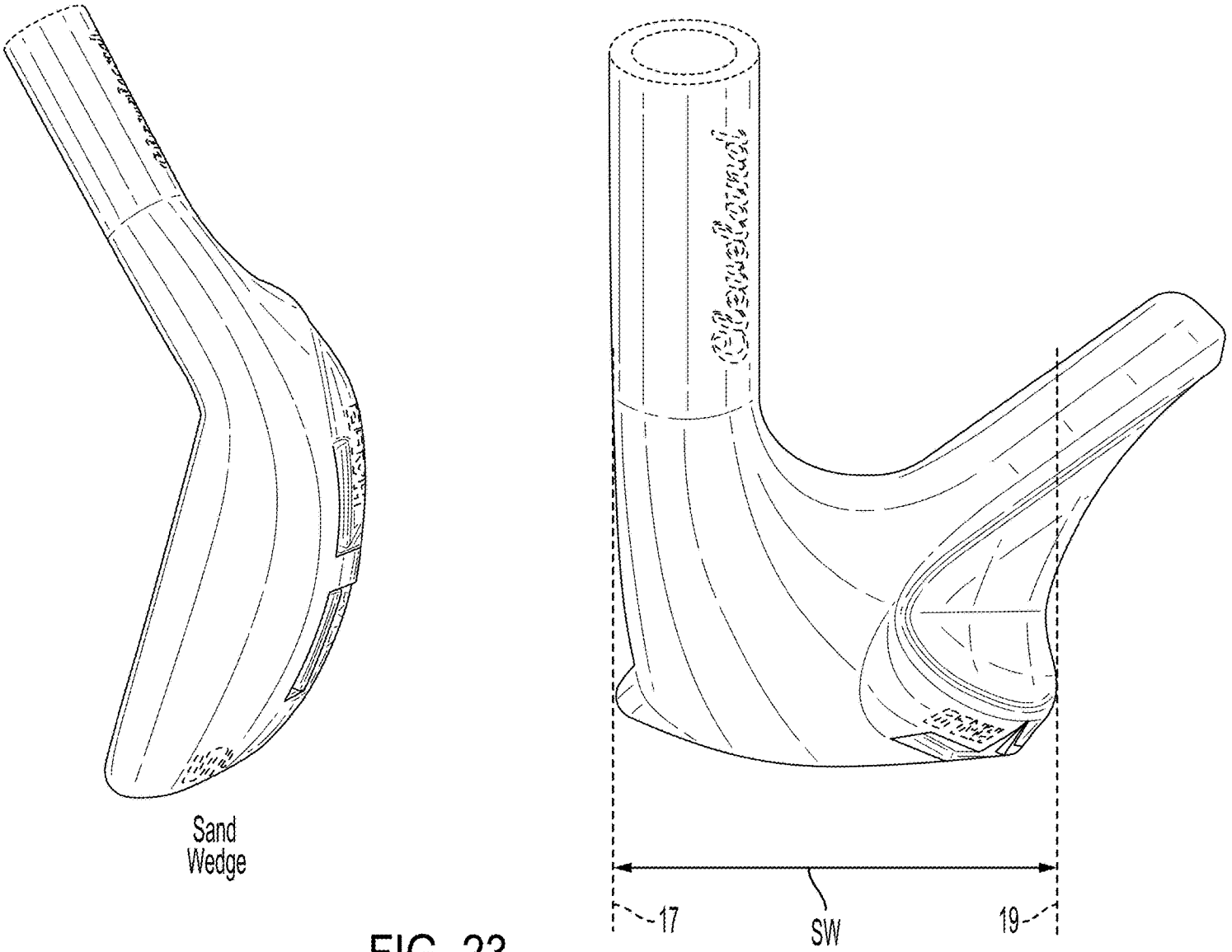
FIG. 23 provides a bottom view and a heel view of a sand wedge golf club head depicting a sole width according to one or more embodiments

FIG. 23 provides a bottom view and a heel view of a sand wedge golf club head depicting a sole width SW measured between a virtual vertical leading edge plane 17 and a virtual vertical trailing edge plane 19 according to one or more embodiments. In some implementations of a set of iron-type golf clubs, the sole width SW decreases as the loft angle LA increases from a four iron to a pitching wedge, while the sole width SW increases as the loft angle LA increases from a pitching wedge to a sand wedge to provide more bounce and forgiveness on wedge specific shots, such as for pitching, chipping, bunker, and flop shots. Example sole widths SWs and loft angles LAs for a set of iron-type golf clubs including variable face thickness patterns and reshaped internal weight pads discussed above are provided in Table 10 below.

TABLE 10

| Relative Club Length | Club Number | Sole Width SW | Loft Angle LA |
|---|---|---|---|
| Long | 4 | 53.4 mm | 20 degrees |
| Long | 5 | 49.1 mm | 23 degrees |
| Mid | 6 | 45.1 mm | 26.5 degrees |
| Mid | 7 | 40.9 mm | 30 degrees |
| Mid | 8 | 38.3 mm | 34.5 degrees |
| Short | 9 | 35.2 mm | 39 degrees |
| Short | Pitching Wedge | 32.5 mm | 44 degrees |
| Short | Dual Wedge | 33.8 mm | 49.5 degrees |
| Short | Sand Wedge | 38 mm | 54.5 degrees |

Figure 24:
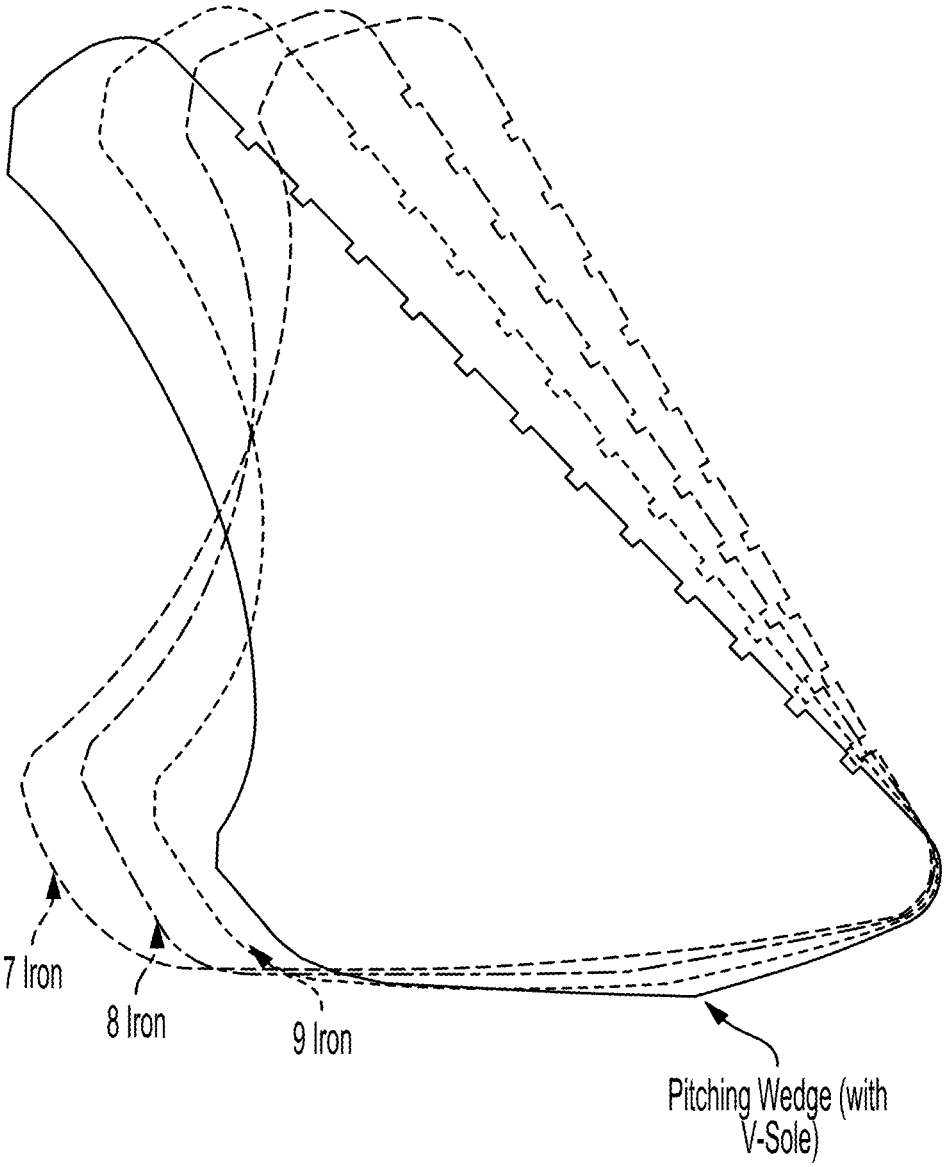
FIG. 24 illustrates an overlay of the outlines of vertical cross-sections of a seven iron golf club head, an eight iron golf club head, a nine iron golf club head, and a pitching wedge golf club head according to one or more embodiments.

FIG. 24 illustrates an overlay of the outlines of vertical cross-sections of a seven iron golf club head, an eight iron golf club head, a nine iron golf club head, and a pitching wedge golf club head according to one or more embodiments. The vertical cross-sections may be taken along a virtual vertical plane passing through the striking face center and perpendicular to the striking face. As shown in FIG. 25, the sole widths SWs decrease as the loft angle LA increases from the 7 iron to the pitching wedge. The V-shaped sole of the pitching wedge is also shown in FIG. 24.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the scope of the present disclosure. For example, some alternative embodiments may include different sizes or shapes of regions or parameterization zones of a striking face or different sizes or shapes of internal weight pads. Accordingly, the described embodiments are to be considered in all respects only as illustrative and not restrictive, and the scope of the disclosure is, therefore, indicated by the following claims rather than by the foregoing description. All changes which come within the meaning and range of equivalency of the claims are to be embraced within their scope. In addition, the use of language in the form of "at least one of A and B" in the following claims should be understood to mean "only A, only B, or both A and B."

The invention claimed is:

1. A set of iron-type golf clubs, comprising:

at least two golf clubs each including a golf club head that, when oriented in a reference position, comprises:

a striking face comprising a face center and a variable thickness such that the striking face has a perimeter region proximate an outer boundary of the striking face and a maximum thickness of the striking face is located in the perimeter region;

a shell including a crown, a sole opposite the crown, a heel, a toe, and an internal weight pad located on a lower portion of the shell;

a loft angle LA of at least 20 degrees; and a center of gravity having a center of gravity depth D, wherein the center of gravity depths of the at least two of the golf club heads satisfy the equation:

$$19\text{ mm}-0.36\text{ mm/degrees}*LA<D<22\text{ mm}-0.36\text{ mm/degrees}*LA,$$

wherein the at least two golf club heads have a difference in loft angle LA of at least 5 degrees, and wherein a moment of inertia about a vertical axis through the center of gravity of each of the at least two golf club heads is at least 2900 g*cm$^2$.

2. The set of iron-type golf clubs of claim 1, wherein the weight pad and the shell comprise a unitary investment casted component.

3. The set of iron-type golf clubs of claim 1, wherein the weight pad is entirely spaced apart from the striking face.

4. The set of iron-type golf clubs of claim 1, wherein the striking face comprises a face insert.

5. The set of iron-type golf clubs of claim 4, wherein the face insert comprises a material different from the shell.

6. The set of iron-type golf clubs of claim 1, wherein a moment of inertia about a horizontal axis substantially parallel to the striking face through the center of gravity of the at least two golf club heads is at least 900 g*cm2.

7. The set of iron-type golf clubs of claim 1, wherein the weight pad of the higher lofted head of the at least two golf club heads has a first center of gravity located toe-ward of the center of gravity of the head center of gravity and the weight pad of the lower lofted head of the at least two golf club heads has a second center of gravity that is more toe-ward than the first center of gravity.

8. The set of iron-type golf clubs of claim 1, wherein the weight pad comprises a weight port and the at least two golf club heads each include a removable weight received in the weight port.

9. The set of iron-type golf clubs of claim 1, wherein the center of gravity depths of at least two of the golf club heads satisfy the equation: D=a−b*L, with 20 mm<a<21 mm and b=0.36 mm/degrees.

10. The set of iron-type golf clubs of claim 1, wherein the striking face comprises a center region having a first thickness T1, an intermediate region having a second thickness T2 surrounding the center region, and a perimeter region surrounding the intermediate region having a third thickness T3, and wherein T2<T1<T3.

11. The set of iron-type golf clubs of claim 10, wherein the striking face of the at least two golf clubs have substantially the same variable thickness pattern.

12. The set of iron-type golf clubs of claim 1, wherein the golf club head has a weighted COR of at least 0.70, the weighted COR being determined based on the following relationship:

$$\text{Weighted COR}=\Sigma_{i=1}^{n}\Sigma_{j=1}^{m}p_{ij}*c_{ij},$$

wherein:

(a) a rectangular virtual evaluation region is superimposed onto the striking face, the rectangular virtual evaluation region comprising a first pair of horizontal sides having a length of 35 mm, a second pair of vertical sides having a length of 25 mm, and a geometric center that coincides with the face center;

(b) the rectangular virtual evaluation region is divided into 5 rows (m) having an equal height of 5 mm and is divided into 7 columns (n) having an equal width of 5 mm, thereby forming a matrix of bins having coordinates i and j;

(c) $c_{ij}$ corresponds to an average COR value associated with bin i, j;

(d) $p_{ij}$ corresponds to a bin-specific impact probability value in accordance with the following:

| | i = 1 | i = 2 | i = 3 | i = 4 | i = 5 | i = 6 | i = 7 |
|---|---|---|---|---|---|---|---|
| j = 1 | 0.42% | 0.43% | 0.30% | 0.22% | 0.11% | 0.03% | 0.03% |
| j = 2 | 3.58% | 3.64% | 2.96% | 2.23% | 1.20% | 0.76% | 0.31% |

-continued

| | i = 1 | i = 2 | i = 3 | i = 4 | i = 5 | i = 6 | i = 7 |
|---|---|---|---|---|---|---|---|
| j = 3 | 5.46% | 8.29% | 8.54% | 6.50% | 4.42% | 2.43% | 1.06% |
| j = 4 | 3.36% | 5.97% | 6.55% | 6.65% | 5.01% | 2.83% | 1.19% |
| j = 5 | 1.52% | 2.43% | 3.31% | 3.18% | 2.49% | 1.80% | 0.81% |

13. An iron type golf club head that, when oriented in a reference position, comprises:

a striking face comprising a face center and a variable thickness with a center region having a first thickness T1, an intermediate region having a second thickness T2 surrounding the center region, and a perimeter region surrounding the intermediate region having a third thickness T3, and wherein T2<T1<T3;

a shell including crown, a sole opposite the crown, a heel, a toe, and an internal weight pad located on a lower portion of the shell;

a loft angle LA of at least 20 degrees; and a center of gravity having a center of gravity depth D that satisfies the equation:

$$19\text{ mm}-0.36\text{ mm/degrees}*LA<D<22\text{ mm}-0.36\text{ mm/degrees}*LA,$$

wherein a moment of inertia about a vertical axis through the center of gravity of each of the at least two golf club heads is at least 2900 g*cm$^2$.

14. The iron-type golf club head of claim 13, wherein the weight pad and the shell comprise a unitary investment casted component.

15. The iron-type golf club head of claim 13, wherein the weight pad is entirely spaced apart from the striking face.

16. The iron-type golf club head of claim 13, wherein the striking face comprises a face insert.

17. The iron-type golf club head of claim 13, wherein the weight pad comprises a U shape.

18. The iron-type golf club head of claim 13, wherein the weight pad is located substantially toe-ward of the head center of gravity.

* * * * *